US009527278B2

(12) United States Patent
Sakurada et al.

(10) Patent No.: US 9,527,278 B2
(45) Date of Patent: Dec. 27, 2016

(54) IMAGE FORMING APPARATUS, IMAGE FORMING METHOD, AND COMPUTER-READABLE STORAGE MEDIUM

(71) Applicants: Yuichi Sakurada, Tokyo (JP); Mamoru Yorimoto, Kanagawa (JP); Tatsuhiko Okada, Kanagawa (JP); Daisaku Horikawa, Kanagawa (JP); Makoto Moriwaki, Kanagawa (JP)

(72) Inventors: Yuichi Sakurada, Tokyo (JP); Mamoru Yorimoto, Kanagawa (JP); Tatsuhiko Okada, Kanagawa (JP); Daisaku Horikawa, Kanagawa (JP); Makoto Moriwaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/092,616

(22) Filed: Nov. 27, 2013

(65) Prior Publication Data

US 2014/0146101 A1 May 29, 2014

(30) Foreign Application Priority Data

Nov. 29, 2012 (JP) ..... 2012-260913
Jun. 18, 2013 (JP) ..... 2013-127863

(51) Int. Cl.
*B41J 29/38* (2006.01)
*B41J 2/045* (2006.01)

(52) U.S. Cl.
CPC ..... *B41J 2/04563* (2013.01); *B41J 2/04503* (2013.01); *B41J 2/04551* (2013.01); (Continued)

(58) Field of Classification Search
CPC . B41J 2/04563; B41J 2/04581; B41J 2/04588; B41J 2/04541; B41J 2/0458; B41J 2/04501; B41J 2/04508; B41J 2/04553; B41J 2/04573; B41J 2/0459; B41J 2/04591; B41J 2/365; B41J 29/38; B41J 29/393
(Continued)

(56) References Cited

U.S. PATENT DOCUMENTS 5,975,669 A * 11/1999 Ohshima ..... 347/14
6,145,949 A * 11/2000 Takahashi ..... 347/14
(Continued)

FOREIGN PATENT DOCUMENTS

JP 09-052360 2/1997
JP 2011-079296 4/2011

*Primary Examiner* — Jannelle M Lebron
*Assistant Examiner* — Jeremy Bishop
(74) *Attorney, Agent, or Firm* — Duft Bornsen & Fettig LLP

(57) ABSTRACT

An image forming apparatus includes a recording-head carrier including a recording head for ejecting a liquid droplet onto a recording medium, a relative moving unit configured to relatively move the recording-head carrier and the recording medium; an image recording unit configured to drive the recording head by a driving signal having a driving waveform to eject liquid droplets toward the recording medium while relatively moving the recording-head carrier and the recording medium; a driving-waveform determining unit configured to determine the driving waveform of the driving signal based on a detected temperature near the recording head; a drive-timing determining unit configured to determine drive timing at which the recording head is driven by the driving signal, based on the detected temperature; and a drive control unit configured to set the driving waveform and the drive timing to the image recording unit to drive the recording head.

7 Claims, 14 Drawing Sheets

(52) U.S. Cl.
CPC ..... *B41J 2/04573* (2013.01); *B41J 2/04586* (2013.01); *B41J 2/04588* (2013.01)

(58) Field of Classification Search
USPC ..... 347/5, 9, 10, 14
See application file for complete search history.

(56) References Cited

U.S. PATENT DOCUMENTS

| | | | | |
|---|---|---|---|---|
| 6,575,544 | B2 * | 6/2003 | Iriguchi | 347/11 |
| 6,960,036 | B1 * | 11/2005 | Fujita et al. | 400/124.11 |
| 7,178,893 | B2 * | 2/2007 | Noda | 347/10 |
| 7,712,857 | B2 * | 5/2010 | Igarashi | 347/14 |
| 8,277,011 | B2 * | 10/2012 | Suzuki | 347/14 |
| 8,628,163 | B2 * | 1/2014 | Kanematsu et al. | 347/17 |
| 2005/0195227 | A1 * | 9/2005 | Tanaka | B41J 29/38 347/10 |
| 2011/0063352 | A1 | 3/2011 | Sakurada et al. | |
| 2011/0298854 | A1 | 12/2011 | Sakurada et al. | |
| 2012/0194591 | A1 * | 8/2012 | Hagiwara | 347/14 |
| 2012/0249639 | A1 * | 10/2012 | Ozawa | B41J 2/04563 347/10 |

* cited by examiner

FIG.5

| TEMPERATURE | TEMPERATURE RANK | FACTOR |
|---|---|---|
| 0 | 1 | 100 |
| 1 | 1 | 98 |
| 2 | 1 | 95 |
| 3 | 1 | 93 |
| 4 | 1 | 91 |
| 5 | 2 | 100 |
| 6 | 2 | 98 |
| 7 | 2 | 96 |
| 8 | 2 | 94 |
| 9 | 2 | 92 |
| 10 | 3 | 100 |
| 11 | 3 | 98 |
| 12 | 3 | 96 |
| 13 | 3 | 94 |
| 14 | 3 | 92 |
| 15 | 4 | 100 |
| 16 | 4 | 98 |
| 17 | 4 | 96 |
| 18 | 4 | 95 |
| 19 | 5 | 93 |
| 20 | 5 | 100 |
| 21 | 5 | 98 |
| 22 | 5 | 97 |
| 23 | 5 | 96 |
| 24 | 5 | 95 |
| 25 | 6 | 100 |
| 26 | 6 | 99 |
| 27 | 6 | 98 |
| 28 | 6 | 97 |
| 29 | 6 | 96 |
| 30 | 7 | 100 |
| 31 | 7 | 99 |
| 32 | 7 | 98 |
| 33 | 7 | 97 |
| 34 | 7 | 97 |
| 35 | 8 | 100 |
| 36 | 8 | 100 |
| 37 | 8 | 99 |
| 38 | 8 | 99 |
| 39 | 8 | 98 |
| 40 | 8 | 98 |
| 41 | 8 | 98 |
| 42 | 8 | 97 |
| 43 | 8 | 97 |
| 44 | 8 | 97 |

FIG.6

| No. | TEMPERATURE RANGE | | IMAGE RECORDING MODE | | | |
|---|---|---|---|---|---|---|
| | | | BI-DIRECTIONAL HIGH-SPEED/ STANDARD MODE | UNI-DIRECTIONAL HIGH-SPEED MODE | UNI-DIRECTIONAL HIGH-QUALITY MODE | ANTI-CONTAMINATION MODE |
| 1 | | <1℃ | 5000 | 0 | 0 | 0 |
| 2 | ≥1℃ | <2℃ | 5000 | 0 | 0 | 0 |
| 3 | ≥2℃ | <3℃ | 5000 | 0 | 0 | 0 |
| ⋮ | ⋮ | ⋮ | ⋮ | ⋮ | ⋮ | ⋮ |
| 28 | ≥27℃ | <28℃ | 5000 | 0 | 0 | 0 |
| 29 | ≥28℃ | <29℃ | 5000 | 0 | 0 | 0 |
| 30 | ≥29℃ | <30℃ | 5000 | 0 | 0 | 0 |
| 31 | ≥30℃ | <31℃ | 1808 | 0 | 0 | 0 |
| 32 | ≥31℃ | <32℃ | 1728 | 0 | 0 | 0 |
| 33 | ≥32℃ | <33℃ | 1648 | 0 | 0 | 0 |
| 34 | ≥33℃ | <34℃ | 1576 | 0 | 0 | 0 |
| 35 | ≥34℃ | <35℃ | 1496 | 0 | 0 | 0 |
| 36 | ≥35℃ | <36℃ | 1416 | 0 | 0 | 0 |
| 37 | ≥36℃ | <37℃ | 1344 | 0 | 0 | 0 |
| 38 | ≥37℃ | <38℃ | 1264 | 0 | 0 | 0 |
| 39 | ≥38℃ | <39℃ | 1184 | 0 | 0 | 0 |
| 40 | ≥39℃ | <40℃ | 1112 | 0 | 0 | 0 |
| 41 | ≥40℃ | <41℃ | 1032 | 0 | 0 | 0 |
| 42 | ≥41℃ | <42℃ | 960 | 0 | 0 | 0 |
| 43 | ≥42℃ | <43℃ | 880 | 0 | 0 | 0 |
| 44 | ≥43℃ | <44℃ | 800 | 0 | 0 | 0 |
| 45 | ≥44℃ | | 728 | 0 | 0 | 0 |

FIG.11

CARRIAGE VELOCITY TABLE

| No. | TEMPERATURE RANGE | | CARRIAGE VELOCITY (mm/s) |
|---|---|---|---|
| 1 | | <1°C | 1016 |
| 2 | ≥1°C | <2°C | 1016 |
| 3 | ≥2°C | <3°C | 1016 |
| ⋮ | ⋮ | ⋮ | ⋮ |
| 28 | ≥27°C | <28°C | 1016 |
| 29 | ≥28°C | <29°C | 1016 |
| 30 | ≥29°C | <30°C | 1016 |
| 31 | ≥30°C | <31°C | 914 |
| 32 | ≥31°C | <32°C | 904 |
| 33 | ≥32°C | <33°C | 894 |
| 34 | ≥33°C | <34°C | 888 |
| 35 | ≥34°C | <35°C | 878 |
| 36 | ≥35°C | <36°C | 868 |
| 37 | ≥36°C | <37°C | 858 |
| 38 | ≥37°C | <38°C | 848 |
| 39 | ≥38°C | <39°C | 838 |
| 40 | ≥39°C | <40°C | 828 |
| 41 | ≥40°C | <41°C | 816 |
| 42 | ≥41°C | <42°C | 806 |
| 43 | ≥42°C | <43°C | 796 |
| 44 | ≥43°C | <44°C | 786 |
| 45 | ≥44°C | | 775 |

(a)

(b)

IMAGE FORMING APPARATUS, IMAGE FORMING METHOD, AND COMPUTER-READABLE STORAGE MEDIUM

CROSS-REFERENCE TO RELATED APPLICATIONS

The present application claims priority to and incorporates by reference the entire contents of Japanese Patent Application No. 2012-260913 filed in Japan on Nov. 29, 2012 and Japanese Patent Application No. 2013-127863 filed in Japan on Jun. 18, 2013.

BACKGROUND OF THE INVENTION

1. Field of the Invention

The present invention relates generally to an image forming apparatus, an image forming method, and a computer-readable storage medium.

2. Description of the Related Art

Liquid-droplet-ejecting image forming apparatuses that form an image by ejecting droplets of liquid such as ink onto a recording medium such as a media sheet, on which an image is to be formed, have emerged recently.

Such a liquid-droplet-ejecting image forming apparatus is capable of direct, contactless printing without requiring development, fixing, and the like processes, and therefore capable of high-speed, low-noise, high-image-quality color printing on not only ordinary paper but also on various types of recording media. For this reason, liquid-droplet-ejecting image forming apparatuses have been proliferated.

Emerging are liquid-ejecting image forming apparatuses especially of a type that attains higher image recording speed by causing a carriage including thereon a recording head that ejects a liquid droplet to reciprocate, and an image is recorded during both of forward and backward traveling of the carriage rather than only during traveling in a single direction. For the sake of clarity, it is assumed in the description below that ink is used as the liquid. Liquid droplets are referred to as ink droplets; a liquid-ejecting image forming apparatus is referred to as an inkjet image forming apparatus or the like.

Meanwhile, the viscosity of ink to be ejected changes with temperature such that the higher the temperature, the lower the viscosity.

When the viscosity of ink to be ejected from an inkjet image forming apparatus decreases, an amplitude of ink meniscus (convex or concave surface of the ink caused by interaction between a surface of a container and the ink) increases, and anomalous ejection (ink distortion) occurs.

Against this backdrop, an inkjet recording apparatus including a nozzle opening, a pressure generating chamber, an inkjet recording head, and a driving-signal generating unit is disclosed in Japanese Laid-open Patent Application No. H9-52360. The pressure generating chamber has a Helmholtz resonant frequency of a period and communicates with a common ink chamber via an ink supply port. The ink-jet recording head has a piezoelectric vibrator that expands and contracts the pressure generating chamber. The driving-signal generating unit outputs a first signal for expanding the pressure generating chamber, a second signal for causing an ink droplet to be ejected through the nozzle opening by contracting the pressure generating chamber from an expanded state, and a third signal to be output when vibration of a meniscus generated after the ink droplet is ejected travels toward the nozzle opening.

More specifically, this conventional technique adjusts an amount, by which the meniscus is to be pulled, according to the temperature, so that a resistance in an ink channel extending to the nozzle opening is cancelled out by the viscosity of the ink, and the volume of the ink droplet and a flying velocity, at which the ink droplet flies through the air, are held constant.

As described above, the conventional technique adjusts the amount, by which the meniscus is to be pulled, according to the temperature, so that the resistance in the ink channel extending to the nozzle opening is canceled out by the viscosity of the ink, and the volume of the ink droplet and the flying velocity of the ink droplet are held constant. However, in this technique, an ink droplet flies in a high-temperature condition at the same velocity as that in a low-temperature condition. Accordingly, there arises a problem in the high temperature condition where the ink viscosity decreases that anomalous ejection (nozzle distortion) occurs, which results in degradation in image quality.

Therefore, there is a need for providing a technique that allows forming a high-quality image by reducing distortion of liquid ejection in a high-temperature condition.

SUMMARY OF THE INVENTION

It is an object of the present invention to at least partially solve the problems in the conventional technology.

According to an embodiment, there is provided an image forming apparatus that includes a recording-head carrier including a recording head for ejecting a liquid droplet onto a recording medium, the recording-head carrier moving relative to the recording medium; a relative moving unit configured to relatively move the recording-head carrier and the recording medium; an image recording unit configured to drive the recording head by a driving signal having a specified driving waveform to eject liquid droplets toward the recording medium to thus record an image while causing the relative moving unit to relatively move the recording-head carrier and the recording medium; a temperature detecting unit configured to detect a temperature near the recording head; a driving-waveform determining unit configured to determine the driving waveform of the driving signal based on the temperature detected by the temperature detecting unit; a drive-timing determining unit configured to determine drive timing at which the recording head is driven by the driving signal, based on the temperature detected by the temperature detecting unit; and a drive control unit configured to set the driving waveform determined by the driving-waveform determining unit and the drive timing determined by the drive-timing determining unit to the image recording unit to cause the image recording unit to drive the recording head in accordance with the driving waveform and the drive timing.

According to another embodiment, there is provided an image forming method that includes relatively moving a recording-head carrier and a recording medium, the recording-head carrier including a recording head for ejecting a liquid droplet onto the recording medium; driving the recording head by a driving signal having a specified driving waveform to eject liquid droplets toward the recording medium to thus record an image while relatively moving the recording-head carrier and the recording medium; detecting a temperature near the recording head; determining the driving waveform of the driving signal based on the detected temperature of the recording head; determining drive timing at which the recording head is driven by the driving signal, based on the detected temperature of the recording head; and setting the driving waveform determined and the drive timing determined to the image recording unit to drive the recording head in accordance with the driving waveform and the drive timing.

According to still another embodiment, there is provided a non-transitory computer-readable storage medium with an executable program stored thereon and executed by a computer. The program instructs the computer to perform the image forming method according to any one of the embodiments described above.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 5 is a diagram illustrating an example of a driving waveform table;

FIG. 6 is a diagram illustrating an example of an ejection-timing correction table;

FIG. 11 is a diagram illustrating an example of a carriage velocity table for use by an image forming apparatus according to a second embodiment of the present invention;

DETAILED DESCRIPTION OF THE PREFERRED EMBODIMENTS

Preferred embodiments of the present invention are described in detail below with reference to the accompanying drawings. Described below are preferred embodiments of the present invention and technically preferable various limitations are given to the embodiments; however, these embodiments are not to be construed as unduly limiting the scope of the present invention. In addition, all of elements of the embodiments described below should not be taken as essential requirements of the present invention.

First Embodiment

Figure 1:
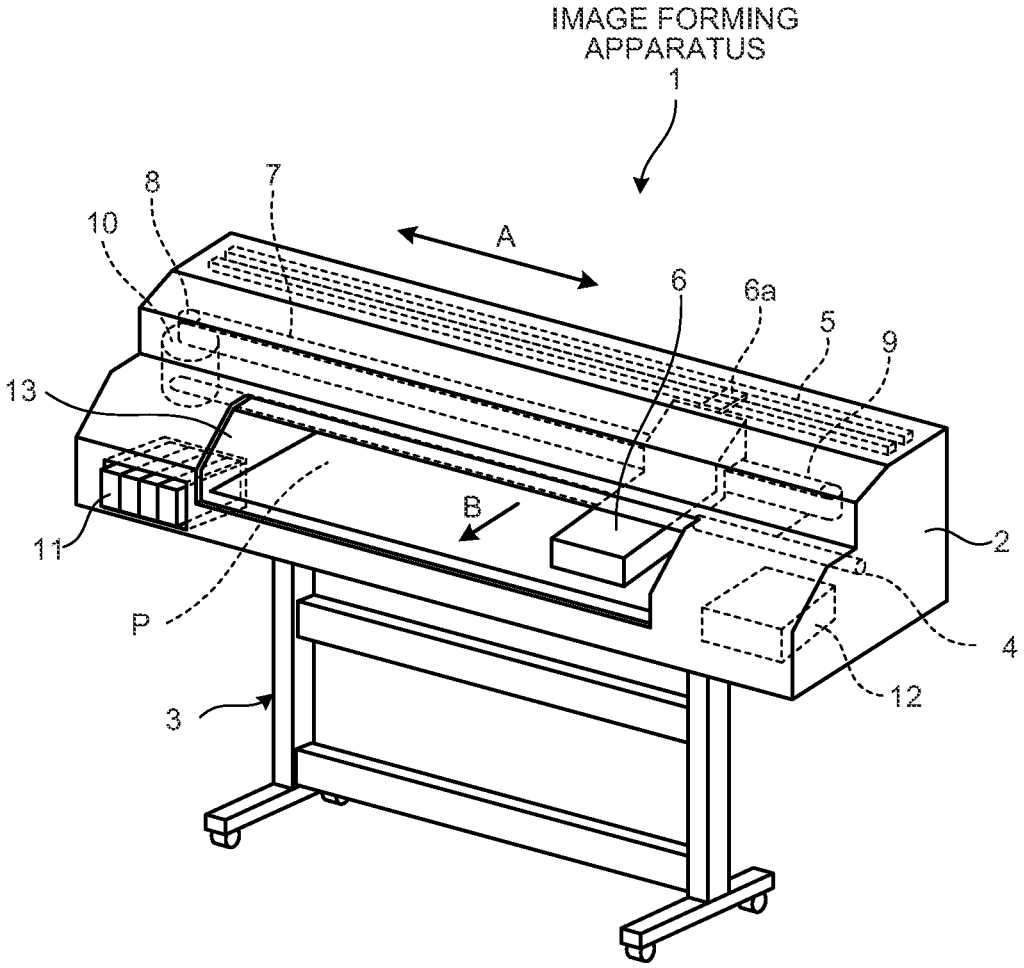
FIG. 1 is a schematic perspective view of an image forming apparatus according to a first embodiment of the present invention.

FIGS. 1 to 10 are diagrams illustrating an image forming apparatus, an image forming method, and a computer program product for image forming according to a first embodiment of the present invention. FIG. 1 is a schematic perspective view of an image forming apparatus 1, to which the image forming apparatus, the image forming method, and the computer program product for image forming according to the first embodiment are applied.

Referring to FIG. 1, the image forming apparatus 1 is a serial, liquid-ejecting (inkjet) image forming apparatus including a body casing 2 arranged on a body frame 3. The image forming apparatus 1 includes, in the body casing 2, a main guide rod 4 and a sub guide rod 5 each supported at its opposite ends to lie along the main-scanning direction indicated by a double-headed arrow A in FIG. 1. The main guide rod 4 movably supports a carriage 6. The carriage 6 includes a connecting piece 6*a* for stabilizing the carriage 6 by being engaged with the sub guide rod 5.

The image forming apparatus 1 includes a timing belt 7, which is an endless belt, along the main guide rod 4. The timing belt 7 is supported on and around a driving pulley 8 and a driven pulley 9 in a tensioned manner. The driving pulley 8 is rotated by a main-scanning motor 10. The driven pulley 9 is arranged so as to apply a preset amount of tension to the timing belt 7. The driving pulley 8 is rotated by the main-scanning motor 10 forward or backward, thereby rotating the timing belt 7 forward or backward, which depends on the rotating direction of the driving pulley 8, in the main-scanning direction.

Figure 2:
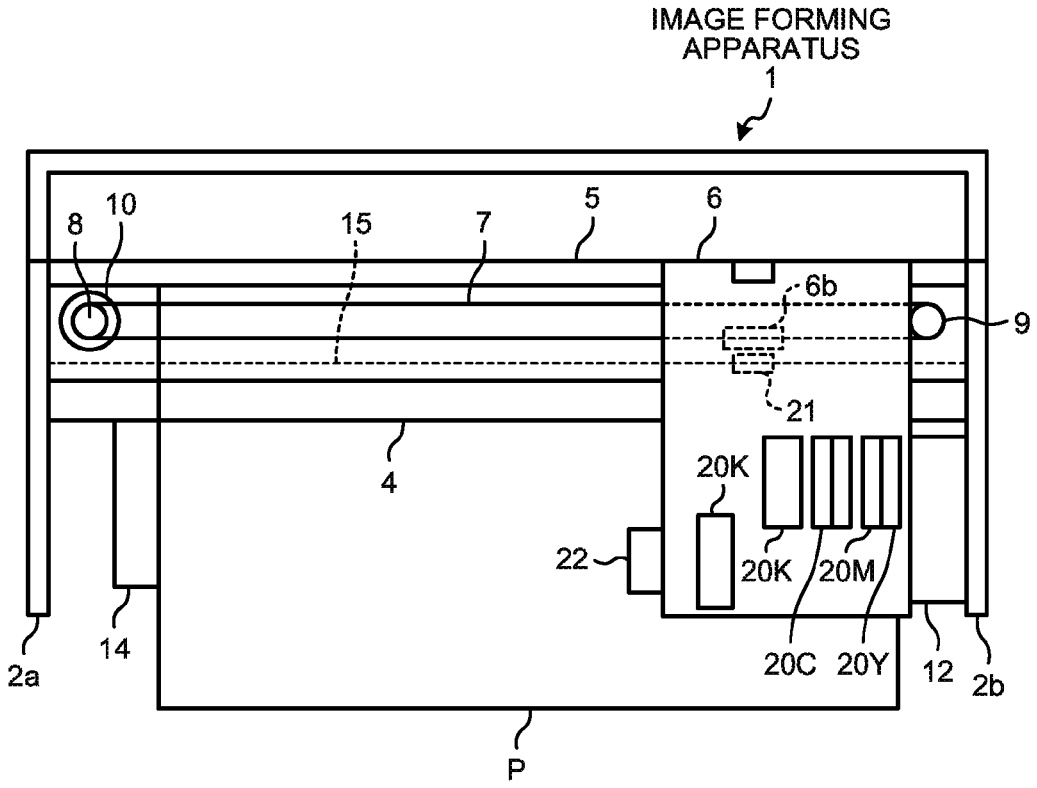
FIG. 2 is a plan view of a carriage and relevant parts therearound.

The carriage 6 is connected to the timing belt 7 via a belt holder 6*b* (see FIG. 2). When the timing belt 7 is rotated in the main-scanning direction by the driving pulley 8, rotation of the timing belt 7 causes the carriage 6 to reciprocate in the main-scanning direction along the main guide rod 4.

The image forming apparatus 1 includes a cartridge unit 11 and a maintenance mechanism unit 12 at positions near opposite ends, respectively, in the main-scanning direction of the body casing 2. The cartridge unit 11 replaceably houses therein cartridges each containing one of yellow (Y) ink, cyan (C) ink, magenta (M) ink, and black (K) ink. Each of the cartridges of the cartridge unit 11 is connected via a pipe (not shown) to one of recording heads 20 or, more specifically, recording heads 20Y, 20M, 20C, and 20K (see FIG. 2), of a corresponding color that are mounted on the carriage 6. Each of the cartridges supplies ink from the cartridge to the recording head 20Y, 20M, 20C, or 20K via the pipe. In the description below, the recording heads 20Y, 20M, 20C, and 20K are collectively referred to as the "recording heads 20".

As will be described later, the image forming apparatus 1 records an image on a recording member P by ejecting ink onto the recording member P that is intermittently conveyed over a platen 14 (see FIG. 2) in the sub-scanning direction (direction indicated by arrow B in FIG. 1) perpendicular to the main-scanning direction while concurrently moving the carriage 6 in the main-scanning direction.

More specifically, the image forming apparatus 1 according to the first embodiment forms an image on the recording member P as follows. The recording member P is intermittently conveyed in the sub-scanning direction. During a period when conveyance of the recording member P in the sub-scanning direction is stopped, ink is ejected onto the recording member P on the platen 14 from nozzle arrays of the recording heads 20Y to 20K mounted on the carriage 6 that is being moved in the main-scanning direction.

The maintenance mechanism unit 12 applies cleaning, capping, purging unnecessary ink, and the like to the recording heads 20Y to 20K, thereby discharging unnecessary ink from the recording heads 20Y to 20K and maintaining reliability of the recording heads 20Y to 20K.

The image forming apparatus 1 includes a cover 13 that has an openable portion, through which the recording member P is to be conveyed. At maintenance or at occurrence of paper jam, the image forming apparatus 1 allows performing a maintenance operation or removal of the recording member P in the body casing 2 by opening the cover 13.

As illustrated in FIG. 2, the carriage (movable body) 6 includes thereon the recording heads 20Y, 20M, 20C, and 20K. Each of the recording heads 20Y, 20M, 20C, and 20K is connected via the pipe to one, of a corresponding color, of the cartridges of the cartridge unit 11. Each of the recording heads 20Y, 20M, 20C, and 20K ejects ink of the corresponding color to the recording member P facing them. More specifically, the recording head 20Y ejects yellow (Y) ink; the recording head 20M ejects magenta (M) ink; the recording head 20C ejects cyan (C) ink; the recording heads 20K eject black (K) ink.

The recording heads 20 are mounted on the carriage 6 with their ejection surfaces (nozzle surfaces) facing down in FIG. 1 (i.e., facing the recording member P) and eject ink onto the recording member P.

The image forming apparatus 1 includes an encoder scale 15 arranged parallel to the timing belt 7, or, in other words, parallel to the main guide rod 4, and extending at least across a movable area of the carriage 6. An encoder sensor 21 for reading the encoder scale 15 is attached to the carriage 6. The image forming apparatus 1 controls traveling of the carriage 6 in the main-scanning direction by controlling driving of the main-scanning motor 10 based on a signal output from the encoder sensor 21 as a result of reading the encoder scale 15.

The main guide rod 4 and the sub guide rod 5 are fixedly supported between and by a left side plate 2*a* and a right side plate 2*b* of the body casing 2.

As illustrated in FIG. 2, the recording heads 20 mounted on the carriage 6 are configured such that each of the recording heads 20Y, 20M, 20C, and 20K includes a plurality of nozzle lines. The recording heads 20Y, 20M, 20C, and 20K form an image on the recording member P by ejecting ink through the nozzle lines onto the recording member P conveyed on the platen 14. The image forming apparatus 1 includes the recording heads 20 on an upstream side and the recording heads 20 on a downstream side on the carriage 6. This arrangement is employed to increase a width of an image to be formed on the recording member P by a single scan motion of the carriage 6 and to increase printing speed in black printing.

A read sensor 22 is attached to the carriage 6. The read sensor 22 reads an adjustment pattern formed on the recording member P in an image-position adjustment process. Although not shown, the read sensor 22 includes a light-emitting element and a light-receiving element that are fixed to and in a holder. Lenses are arranged at a portion, through which reading light emitted from the light-emitting element is to exit, and a portion, through which light to be received by the light-receiving element enters. The light-emitting element and the light-receiving element are aligned in the sub-scanning direction (conveying direction of the recording member P) perpendicular to the main-scanning direction. This configuration allows the read sensor 22 to detect the adjustment pattern in a state where an effect of fluctuations in moving velocity of the carriage 6 is reduced.

Figure 3:
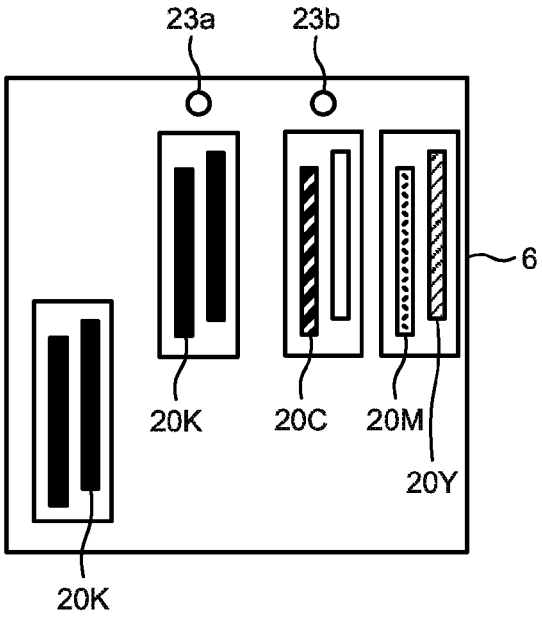
FIG. 3 is a diagram illustrating an example of a temperature sensor mounted on the carriage.

As illustrated in FIG. 3, the carriage 6 includes temperature sensors (temperature detecting unit) 23*a* and 23*b* each of which detects the temperature near the recording heads 20Y to 20K. The temperature sensor 23*a* detects the temperature near the recording head 20K that ejects black (K) ink. The temperature sensor 23*b* detects the temperature near the recording heads 20Y, 20M, and 20C that eject yellow (Y) ink, magenta (M) ink, and cyan (C) ink, respectively. In the following description, the temperature sensor 23*a* and the temperature sensor 23*b* are collectively referred to as the "temperature sensor 23".

Figure 4:
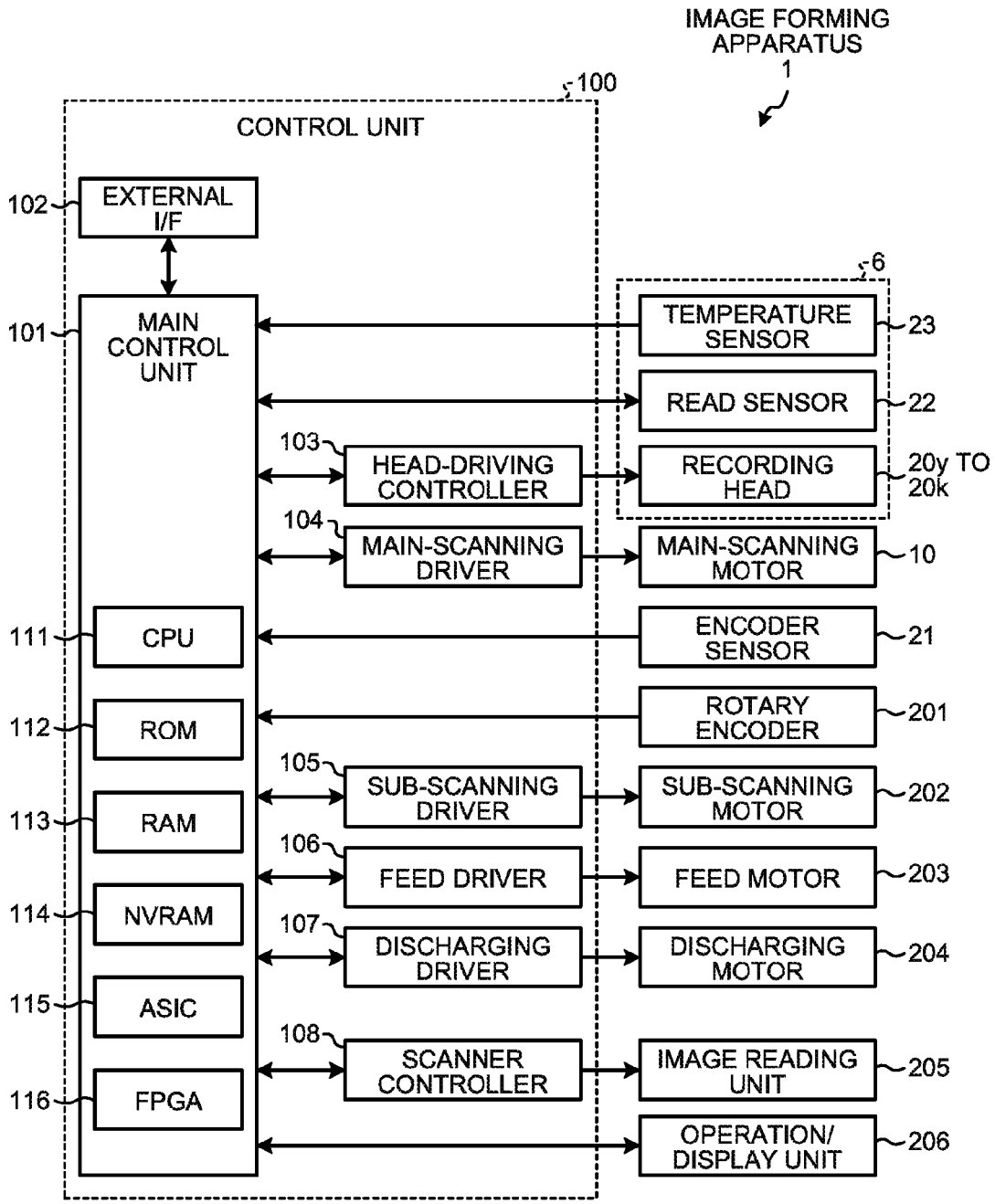
FIG. 4 is a block diagram of a principal portion of the image forming apparatus.

As illustrated in FIG. 4, the image forming apparatus 1 has a block configuration and includes a control unit 100, the carriage 6 including thereon the temperature sensor 23, the read sensor 22, and the recording heads 20Y to 20K, the main-scanning motor 10, the encoder sensor 21, a rotary encoder 201, a sub-scanning motor 202, a feed motor 203, a discharging motor 204, an image reading unit 205, and an operation/display unit 206. The image forming apparatus 1 further includes, although not illustrated, a maintenance/recovery motor that drives the maintenance mechanism unit 12, a recovery-system driver for driving the driving motor, a solenoid driver that drives various types of solenoids, and a clutch driver that drives electromagnetic clutches and the like. Furthermore, the image forming apparatus 1 receives, at a main control unit 101, detection signals output from various other sensors, which are not illustrated.

The control unit 100 includes the main control unit 101, an external I/F 102, a head-driving controller 103, a main-scanning driver 104, a sub-scanning driver 105, a feed driver 106, a discharging driver 107, and a scanner controller 108. The main control unit includes thereon a central processing unit (CPU) 111, a read only memory (ROM) 112, a random access memory (RAM) 113, a non-volatile random access memory (NVRAM) 114, an application specific integrated circuit (ASIC) 115, and a field programmable gate array (FPGA) 116.

In the main control unit 101, basic program instructions for the image forming apparatus 1, program instructions such as those for image forming according to an aspect of the present invention, and necessary data are stored in the ROM 112. The main control unit 101 performs basic processes of the image forming apparatus 1 such that the CPU (control processor) 111 controls units of the image forming apparatus 1 according to the program instructions stored in the ROM 112 by utilizing the RAM 113 as a working memory. The main control unit 101 also performs an image forming process of forming a high-quality image by maintaining ink ejection performance regardless of the temperature according to an aspect of the present invention, which will be described later.

Data that needs to be held even during a period when power supply to the image forming apparatus 1 is off is stored in and read out from the NVRAM 114 under control of the CPU 111.

The ASIC 115 performs various signal processing on image data and image processing such as sorting. The FPGA 116 processes input/output signals for use in controlling the overall image forming apparatus 1.

More specifically, the image forming apparatus 1 is configured as an image forming apparatus that performs an image forming method of forming a high-quality image by reducing distortion of ink (liquid) ejection, which will be described later, that can occur in a high-temperature condition. The image forming method is performed by reading out program instructions for forming a high-quality image by reducing distortion of ejection that can occur in a high-temperature condition according to an aspect of the present invention stored in a computer-readable storage medium such as a ROM, an electrically erasable and programmable read only memory (EEPROM), an EPROM, a flash memory, a flexible disk, a compact disc read only memory (CD-ROM), a compact disc rewritable (CD-RW), a digital versatile disk (DVD), a secure digital (SD) card, or a magneto-optical disc (MO). The program instructions for image forming are a computer-executable program described in a legacy programming language such as assembler, C, C++, C#, or Java (registered trademark), an object-oriented programming language, or the like and can be distributed as being stored in the storage medium described above.

In the first embodiment, the CPU 111 mainly performs the image forming process according to an aspect of the present invention. Alternatively, a large scale integration (LSI) such as the FPGA 116 or the ASIC 115 may perform a part or all of the image forming process. The following description is on an assumption that the main control unit 101 including these elements performs the image forming process according to an aspect of the present invention.

The external I/F 102 interfaces communications between the main control unit 101 and other equipment via a network such as a local area network (LAN) or a communication line such as a private line to deliver data from the external equipment to the main control unit 101. The external I/F 102 also outputs data generated by the main control unit 101 to external equipment. A removable storage medium can be connected to the external I/F 102, and a state in which a program is stored in the storage medium and is distributed via a communication device from outside.

The head-driving controller (image recording unit) 103 controls whether or not each of the recording heads 20Y to 20K is to eject ink and, if the recording head 20 is to eject ink, ejection timing of when to eject an ink droplet and an amount of the ink droplet to be ejected, thereby causing the recording heads 20Y to 20K to record an image on the recording member P. The head-driving controller 103 includes an ASIC (head driver) for array conversion to generate data for use in drive control of the recording heads 20Y to 20K. The head-driving controller 103 generates driving signals, each having a waveform that specifies presence/absence of an ink droplet and the size of the ink droplet based on print data (dot data having undergone dithering and/or the like), and feeds the driving signals to the recording heads 20Y to 20K. Each of the recording heads 20Y, 20M, 20C, and 20K includes switches on a per-nozzle basis. Switching on/off the switches according to the driving signals causes the recording head 20 to eject an ink droplet of the size specified by the print data onto the recording member P at the position specified by the print data. The head driver of the head-driving controller 103 may be arranged on the side of the recording heads 20Y to 20K; alternatively, the head-driving controller 103 and the recording heads 20Y to 20K may be formed integrally in one piece. The head-driving controller (image recording unit) 103 also causes the recording heads 20Y to 20K to record an adjustment pattern T, which will be described later, as an image on the recording member P by controlling driving of the recording heads 20Y to 20K.

The main-scanning driver 104 is what is referred to as a motor driver and drives the main-scanning motor 10 that moves the carriage 6 in the main-scanning direction in a scanning manner under control of the main control unit 101.

Thus, the main-scanning driver 104, the main-scanning motor 10, and the like collectively function as a movable-body driver.

A signal indicating a result of reading the encoder scale 15 is input from the encoder sensor 21 to the main control unit 101. The main control unit 101 detects a position of the carriage 6 in the main-scanning direction based on this read-result signal. The main control unit 101 performs drive control of the main-scanning motor 10 via the main-scanning driver 104 to move the carriage 6 in the main-scanning direction forward or backward to an intended position.

The sub-scanning driver 105 is what is referred to as a motor driver and drives the sub-scanning motor 202 that conveys the recording member P.

A detection signal (pulse) is input from the rotary encoder 201 that detects rotation of the sub-scanning motor 202 to the main control unit 101. The main control unit 101 controls conveyance of the recording member P via a conveying roller (not shown) by detecting a moving amount or, in other words, a medium feed amount, of the recording member P in the sub-scanning direction based on the detection signal and performing drive control of the sub-scanning motor 202 via the sub-scanning driver 105.

Thus, the sub-scanning driver 105, the sub-scanning motor 202, the conveying roller (not shown), and the like collectively function as a conveying unit that conveys the recording member P.

The feed driver 106 drives the feed motor 203 that feeds and delivers the recording member P from a feed tray (not shown).

The discharging driver 107 drives the discharging motor 204 that drives a discharging roller that discharges the recording member P, on which an image is recorded (i.e., formed), onto an output tray (not shown). The sub-scanning driver 105 may be used as the discharging driver 107.

The scanner controller 108 controls driving operations of the image reading unit 205. The image reading unit 205 can be, for example, an image scanner that utilizes a charge coupled device (CCD) or a complementary metal oxide semiconductor (CMOS). The image reading unit 205 scans an original document, reads an image of the document at a predetermined resolution, and outputs a scan result to the scanner controller 108.

The operation/display unit 206 includes various keys necessary for causing the image forming apparatus 1 to perform various operations and also includes a display (e.g., a liquid crystal display) and a lamp such as a light emitting diode (LED). When various operation for causing the image forming apparatus 1 to perform various functional operation is performed using the operation key, the operation/display unit 206 passes data indicative of the operation to the main control unit 101. The operation/display unit 206 also causes display information passed from the main control unit 101 or, more specifically, a command input using the operation key and/or various notification about information to be given to a user from the image forming apparatus 1, on the display. In particular, the operation/display unit 206 is used in various setting operations necessary for the image forming process, which will be described later, according to an aspect of the present invention.

The main control unit (driving-waveform determining unit, drive-timing determining unit, drive control unit) 101 drives the recording heads 20Y to 20K via the head-driving controller 103, thereby causing an image to be formed on the recording member P. To drive the recording heads 20Y to 20K as described above, the main control unit 101 adjusts driving signals to be fed to the recording heads 20Y, 20M, 20C, and 20K in terms of driving waveform and drive timing via the head-driving controller 103 based on the temperature of the recording heads 20Y to 20K detected by the temperature sensor 23.

More specifically, the main control unit 101 performs: driving-waveform determination, in which the head-driving controller 103 determines a driving waveform of a driving signal to be fed to one of the recording heads 20Y to 20K (hereinafter, "recording head 20Y to 20K") based on the temperature of the recording heads 20Y to 20K detected by the temperature sensor 23; drive-timing determination, in which the head-driving controller 103 determines timing (hereinafter, "drive timing") of when to feed the driving signal to the recording head 20Y to 20K based on the temperature of the recording heads 20Y to 20K detected by the temperature sensor 23; and drive control of applying the determined waveform and the determined drive timing to the head-driving controller 103 to cause the head-driving controller 103 to drive the recording head 20Y to 20K in accordance with the driving waveform and the drive timing. Thus, the main control unit 101 functions as the driving-waveform determining unit, the drive-timing determining unit, and the drive control unit.

By adjusting the driving waveform and the drive timing of the driving signal in this manner, the main control unit 101 causes ink to impact at an intended impacting position on the recording member P regardless of the temperature of the recording heads 20Y to 20K, thereby increasing image quality. The main control unit 101 forms a high-quality image by reducing distortion of ink ejection in a condition where, in particular, the temperature of the recording heads 20Y to 20K is high.

Such a driving waveform table as that illustrated in FIG. 5 and such an ejection-timing correction table as that illustrated in FIG. 6 are stored in the ROM 112 of the main control unit 101. Thus, the ROM 112 functions as a driving-waveform storage unit and a drive-timing-correction-value storage unit.

The driving waveform table illustrated in FIG. 5 is a table containing temperatures of the recording heads 20Y to 20K, temperature ranks into which the temperatures are grouped, and driving-waveform adjustment factors to be applied to driving waveforms in each temperature group of the respective temperature ranks. More specifically, the driving signal for driving the recording head 20Y to 20K is generally designed so as to hold the ink volume and the ejection velocity constant across all the temperature regions. When the ejection velocity is held constant, the viscosity of ink decreases in a condition where the temperature of the recording heads 20Y to 20K is high, and an amplitude of a meniscus of the ink becomes large. As a result, stability in ink ejection decreases. More specifically, in a condition where the temperature of the recording heads 20Y to 20K is high, the amplitude of the ink meniscus is large. If the ejection velocity is held constant in this condition, distortion of ink ejection occurs, and an impacting position at which an ink droplet impacts on the recording member P changes. As a result, in the high-temperature condition, image quality of an formed image can degrade such that, for example, the image has a streak.

Against this backdrop, the image forming apparatus 1 according to the first embodiment stores the driving waveform table in the ROM 112. This table is for use in changing a driving waveform so as to reduce an increase in the amplitude of the meniscus in a high-temperature condition, thereby reducing the ink ejection velocity so that distortion of ink ejection is reduced while holding the volume of ejected ink constant.

However, if the ink ejection velocity is reduced, a period of time (hereinafter, "flying period"), over which an ink droplet ejected from the recording head 20Y to 20K flies through the air until impacting on the recording member P, becomes long and, consequently, the impacting position on the recording member P deviates. Against this backdrop, the image forming apparatus 1 according to the first embodiment changes ink ejection timing based on the ejection-timing correction table by an amount that depends on an amount, by which the ink ejection velocity is reduced by changing the driving waveform.

More specifically, the main control unit 101 adjusts the driving waveform and the drive timing of the driving signal to be fed from the head-driving controller 103 to the recording head 20Y to 20K by referring to the driving waveform table and the ejection-timing correction table in the ROM 112 based on the temperature of the recording heads 20Y to 20K detected by the temperature sensor 23.

Note that the ROM 112 does not necessary store the drive-timing correction table for adjustment of the drive timing; alternatively, the ROM 112 may store a drive timing table containing the drive timing of the recording heads 20Y to 20K associated with the temperature of the recording heads 20Y to 20K, for example.

With this alternative configuration, the main control unit 101 may directly read out drive timing from the ROM 112 based on the temperature of the recording heads 20Y to 20K detected by the temperature sensor 23 and apply the drive timing to the head-driving controller 103. In this case, the ROM 112 functions as a drive-timing storage unit.

Operations of the first embodiment are described below. The image forming apparatus 1 according to the first embodiment forms a high-quality image by reducing distortion of ink ejection in a high-temperature condition.

The image forming apparatus 1 uses ink as an image forming agent for forming an image and records an image on the recording member P by ejecting yellow (Y) ink, cyan (C) ink, magenta (M) ink, and black (K) ink onto the recording member P from the recording heads 20Y to 20K.

To increase image quality, it is desirable that ink ejected toward the recording member P from the recording head 20Y to 20K mounted on the carriage 6 moving in the main-scanning direction be held constant in terms of size (volume) of an ink droplet and ejection velocity regardless of the temperature.

The image forming apparatus 1 causes the head-driving controller 103 to feed driving signals each having a specified driving waveform to the recording heads 20Y to 20K to cause the recording heads 20Y to 20K to eject ink droplets. The recording heads 20Y to 20K for the respective colors eject ink droplets toward the recording member P in accordance with the driving signals.

Meanwhile, the viscosity of ink changes with temperature. Accordingly, if the ejection velocity is held constant, the ink viscosity decreases in a condition where the temperature of the recording heads 20Y to 20K is high, and the amplitude of the meniscus becomes large. As a result, stability in ink ejection decreases. More specifically, in a condition where the temperature of the recording heads 20Y to 20K is high, the amplitude of the ink meniscus is large. If the ejection velocity is held constant in this condition, distortion of ink ejection occurs, and an impacting position at which an ink droplet impacts on the recording member P changes. Against this backdrop, the image forming apparatus 1 according to the first embodiment stores the driving waveform table in the ROM 112. This table is for use in changing a driving waveform so as to reduce an increase in the amplitude of the meniscus in a high-temperature condition, thereby reducing the ink ejection velocity so that distortion of ink ejection is reduced while holding the volume of ejected ink constant.

The main control unit 101 adjusts the driving waveform of the driving signal to be fed by the head-driving controller 103 to the recording head 20Y to 20K by referring to the driving waveform table in the ROM 112 based on the temperature of the recording heads 20Y to 20K detected by the temperature sensor 23.

To change the ejection velocity while holding the ink droplet size constant, the driving waveform of the driving signal is ideally changed in increments corresponding to increments of 1° C. of the temperature (hereinafter, "in 1° C. steps"). However, to adjust a driving waveform, it is necessary to assess an actual ink droplet size and an actual ink ejection velocity at the driving waveform. If the driving waveform is to be adjusted in 1° C. steps, workload involved in this assessment becomes considerably heavy. Accordingly, adjusting the driving waveform in 1° C. steps is substantially impracticable. Under the circumstance, the image forming apparatus 1 according to the first embodiment groups temperatures in 5° C. steps as illustrated in FIG. 5, and assigns a driving waveform to each of the temperature groups. Factors, by which a slew rate of a driving waveform in each temperature group is to be changed, are assigned in 1° C. steps. For example, in temperature group 3, which is the group of the temperature rank 3, the factor assigned to 10° C., which is a reference, is 100. The factor assigned to the driving waveform for 11° C. with respect to the driving waveform for 10° C. is 98%.

Figure 7:
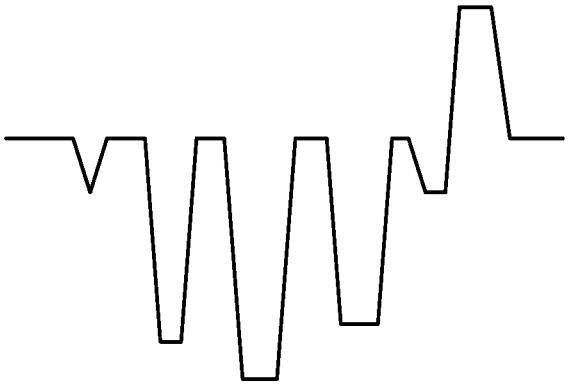
FIG. 7 illustrates an example of a driving waveform.
Figure 7:
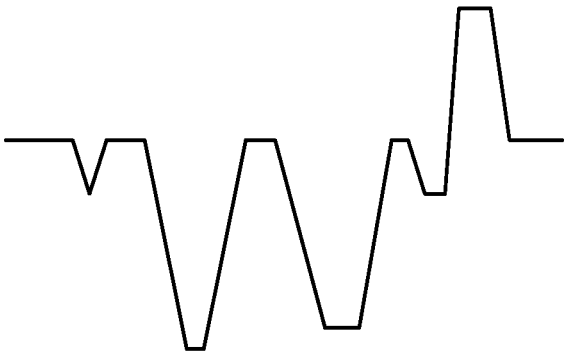
Figure 8:
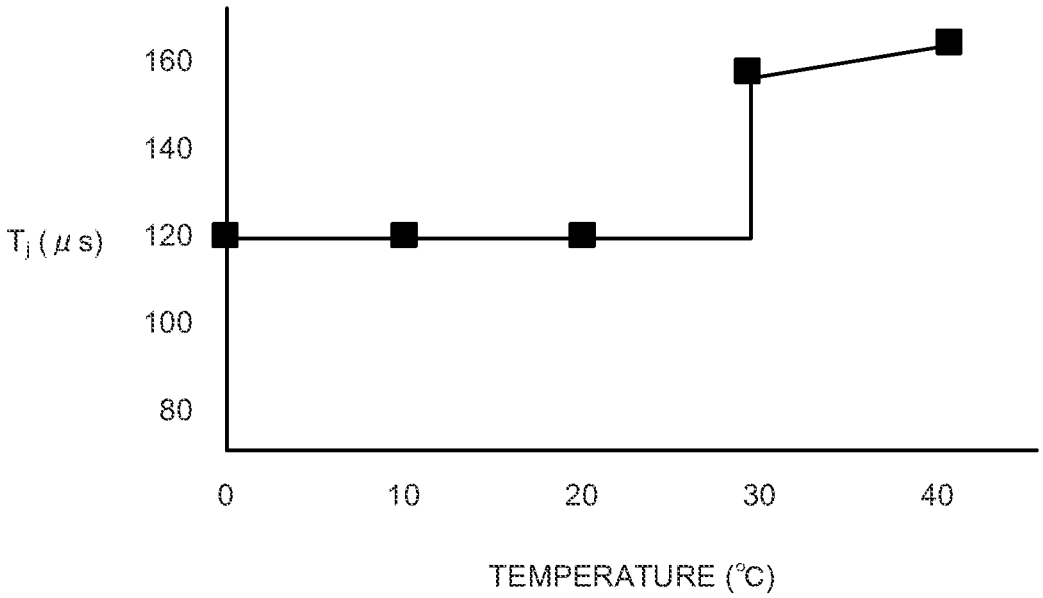
FIG. 8 is a diagram illustrating relationship between temperature of recording heads and ink-droplet flying period.

In practice, taking the viscosity of ink into consideration, ensuring ejection performance while holding the volume of ink constant does not require significant adjustment of the driving waveform in a range of the temperature ranks 1 to 6 in FIG. 5. Accordingly, for instance, such a driving waveform as that illustrated in (a) of FIG. 7 can be employed for this range. By contrast, it is necessary to change the driving waveform to ensure ejection performance while holding the volume of ink constant in a range of the temperature ranks 7 and 8 where the ink viscosity is low. Accordingly, such a driving waveform as that illustrated in (b) of FIG. 7 in which slew rate is larger than that in (a) of FIG. 7 is desirably employed for this range.

Furthermore, if the driving waveform is changed to hold the volume of ejected ink constant regardless of the temperature as described above, the ink ejection velocity decreases. The decrease in the ink ejection velocity produces a side effect that a flying period Tj (μs), over which an ink droplet ejected from the recording head 20Y to 20K flies until impacting on the recording member P, becomes long. In the example illustrated in FIG. 8, the driving waveform considerably changes across a point of 30° C., at which the flying period Tj increases from 120 μs to approximately between 150 and 160 μs.

When the flying period Tj of an ink droplet changes, or, more specifically, becomes longer, an impacting position where an ink droplet that is ejected at the same ejection timing as that in a condition where the temperature of the recording heads 20Y to 20K is lower than 30° C. impacts on the recording member P changes. The longer the flying period Tj, the farther the impacting position changes.

Figure 9:
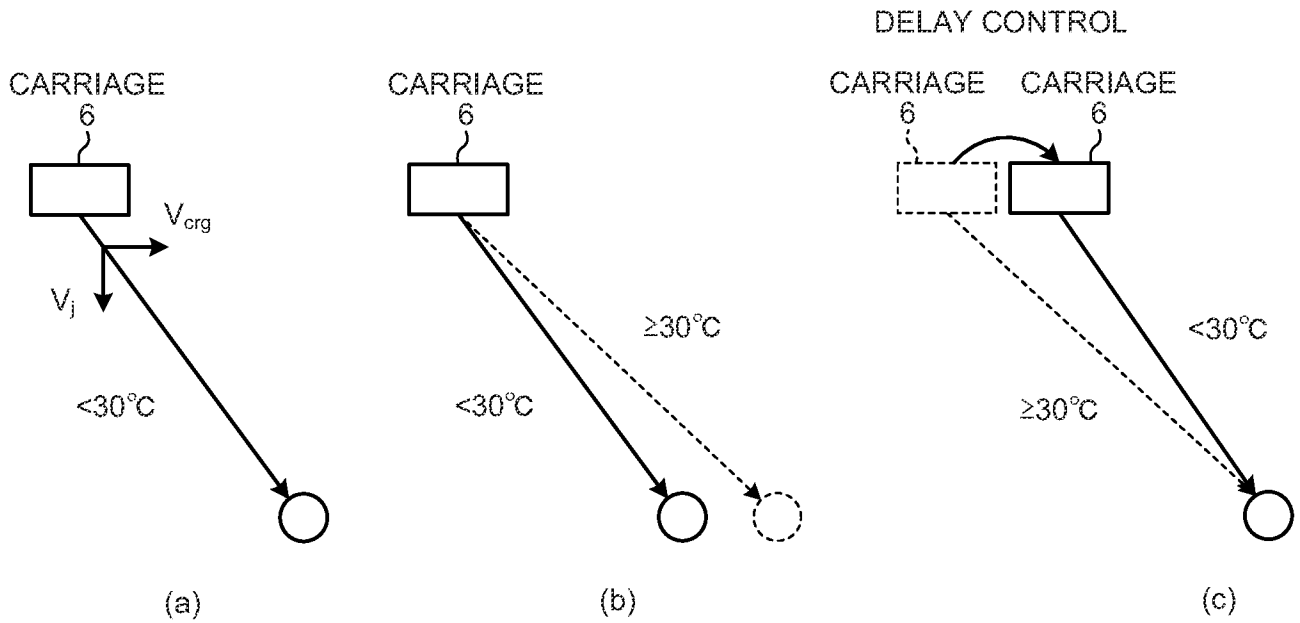
FIG. 9 illustrates relations between temperature of the recording heads and how an ink droplet flies.

Illustrated in (a) of FIG. 9 is how an ink droplet flies in a condition where the temperature of the recording heads 20Y to 20K is lower than 30° C. A direction, in which the ink droplet is ejected, is determined by a velocity (carriage velocity) Vcrg of the carriage 6 and an ink ejection velocity Vj (ink ejection velocity). In FIG. 9, the carriage 6 is moved to the right, and each hollow circle indicates an ink droplet ejected from the recording head 20Y to 20K mounted on the carriage 6 and impacts on the recording member P.

In (b) of FIG. 9, the solid line indicates how an ink droplet flies in a condition where the temperature of the recording heads 20Y to 20K is lower than 30° C.; the dashed line indicates how an ink droplet flies in a condition where the temperature of the recording heads 20Y to 20K is equal to or higher than 30° C.

More specifically, in the condition where the temperature is equal to or higher than 30° C., the slew rate of the driving waveform of the driving signal is lengthened to reduce the ink ejection velocity Vj so that the flying period Tj is lengthened by the amount by which the ink ejection velocity Vj is reduced. However, because the carriage 6 moves at the same moving velocity, the impacting position of the ink droplet deviates in the direction in which the carriage 6 moves as indicated by the dashed line in (b) of FIG. 9.

Against the backdrop, as illustrated in (c) of FIG. 9, in the condition where the temperature is lower than 30° C., the main control unit 101 performs delay control of delaying ink ejection timing with respect to ink ejection timing in the condition where the temperature is equal to or higher than 30° C. so that the impacting position is held constant regardless of the temperature of the recording heads 20Y to 20K.

More specifically, the main control unit 101 stores the ejection-timing correction table illustrated in FIG. 6 in the ROM 112. Delay amounts in 1° C. steps are stored in the ejection-timing correction table. Referring to FIG. 6, delay amounts are assigned to each of a bi-directional high-speed/standard mode, a uni-directional high-speed mode, a uni-directional high-quality mode, and an anti-contamination mode of each of temperature ranges from a temperature range where the temperature is lower than 1° C. to a temperature range where the temperature is equal to or higher than 44° C. In the anti-contamination mode, the carriage 6 is at a certain distance from the recording member P to prevent contamination of the recording heads 20Y to 20K. In the example illustrated in FIG. 6, delay amounts are assigned only to the bi-directional high-speed/standard mode, but not assigned to the other modes. The reason therefor is as follows: a mode where image recording is performed during both of forward and backward traveling of the carriage 6 in the main-scanning direction is only the bi-directional high-speed/standard mode and, in the other modes, image recording is performed only when the carriage 6 moves in a single direction. Accordingly, unless otherwise the temperature should change during recording of a single page, positional deviation will not occur in the other modes.

Referring to FIG. 6, a delay amount "5,000" is assigned to temperature ranges from the temperature range where the temperature is lower than 1° C. to the temperature range where the temperature is lower than 30° C. By contrast, smaller delay amounts, e.g., "1,808" are assigned to temperature ranges where the temperature is equal to or higher than 30° C. such that the higher the temperature, the smaller the delay amount.

The delay amount is applied as follows, for example. When the delay amount is "5,000", which is assigned to the temperature ranges from the temperature range where the temperature is lower than 1° C. to the temperature range where the temperature is lower than 30° C., if the head-driving controller 103 is feeding a driving signal of 80 MHz to the recording head 20Y to 20K, a delay period is calculated as: 5,000/80=62.5 (μs). This delay period of 62.5 μs is to be added.

When the delay amount is "1,808", which is assigned to the temperature range where the temperature is equal to or higher than 30° C. and lower than 31° C., the delay period is calculated as: 1,808/80=22.6 (μs). This delay period of 22.6 μs, which is smaller than that where the temperature is lower than 30° C., is to be added.

Figure 10:
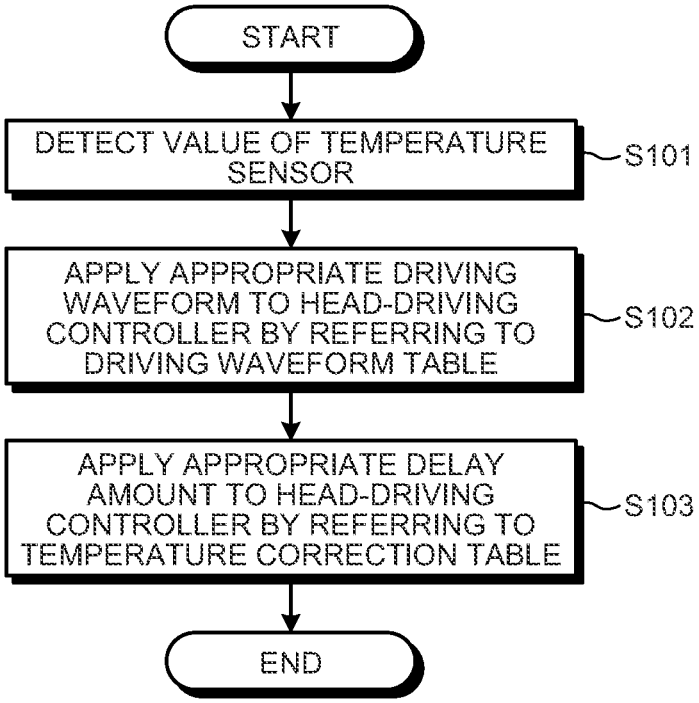
FIG. 10 is a flowchart illustrating a procedure for a temperature-based image forming process.

The main control unit 101 performs an image-forming control process based on the temperature of the recording heads 20Y to 20K in image forming as illustrated in FIG. 10.

More specifically, when performing image forming, the main control unit 101 receives a detected temperature of the recording heads 20Y to 20K from the temperature sensor 23 (Step S101).

The main control unit 101 applies a driving waveform associated with the detected temperature to the head-driving controller 103 by referring to the driving waveform table in the ROM 112 based on the received detected temperature (Step S102).

Subsequently, the main control unit 101 applies a delay amount associated with the detected temperature to the head-driving controller 103 by referring to the ejection-timing correction table in the ROM 112 based on the received detected temperature (Step S103).

When the driving waveform and the delay amount have been applied to the head-driving controller 103, the head-driving controller 103 feeds a driving signal having the applied driving waveform to the recording head 20Y to 20K with timing that is delayed relative to predetermined output timing by the applied delay amount.

The recording heads 20Y to 20K operate in accordance with driving signals fed from the head-driving controller 103 and form an image by ejecting ink droplets onto the recording member P.

Thus, distortion of ejection can be reduced while holding the volume of an ink droplet ejected from the recording head 20Y to 20K constant regardless of the temperature of the recording heads 20Y to 20K. Furthermore, an impacting position where the ink droplet impacts on the recording member P can be adjusted to an intended impacting position.

As described above, according to an aspect of the first embodiment, the image forming apparatus 1 includes: the conveying unit; the carriage (movable body) 6; the movable-body driver; the head-driving controller (image recording unit) 103; the temperature sensor (temperature detecting unit) 23; the main control unit (driving-waveform determining unit) 101; the main control unit (drive-timing determining unit) 101; and the main control unit (drive control unit) 101. The conveying unit includes the sub-scanning driver 105 for conveying the recording member P, the sub-scanning motor 202, and the conveying roller (not shown). The carriage 6 includes thereon the recording heads 20Y to 20K that eject ink droplets (liquid droplets) onto the recording member P and is supported to be movable in the main-scanning direction perpendicular to the conveying direction of the recording member P. The movable-body driver includes the main-scanning driver 104 and the main-scanning motor 10 and moves the carriage 6 in the main-scanning direction. The head-driving controller 103 records an image by feeding driving signals each having a specified driving waveform to the recording heads 20Y to 20K, thereby causing ink droplets to be ejected toward the recording member P, while concertedly causing the movable-body driver to move the carriage 6 in the main-scanning direction. The temperature sensor 23 detects the temperature of the recording heads 20Y to 20K. The main control unit 101 serving as the driving-waveform determining unit determines the driving waveform of the driving signal based on the temperature of the recording heads 20Y to 20K detected by the temperature sensor 23. The main control unit 101 serving as the drive-timing determining unit determines drive timing of when to feed the driving signal to the recording head 20Y to 20K based on the temperature of the recording heads 20Y to 20K detected by the temperature sensor 23. The main control unit 101 serving as the drive control unit applies the determined driving waveform and the determined drive timing to the head-driving controller 103 to cause the head-driving controller 103 to drive the recording head 20Y to 20K in accordance with the driving waveform and the drive timing.

Accordingly, the ejection velocity and the ejection timing can be adjusted while holding the volume of the ink droplet ejected from the recording head 20Y to 20K constant regardless of the temperature of the recording heads 20Y, 20M, 20C, and 20K. As a result, it becomes possible to form a high-quality image by reducing distortion of ink-droplet ejection resulting from a decrease in ink viscosity particularly in a high-temperature condition.

According to an aspect of the first embodiment, the image forming apparatus 1 performs an image forming method including: conveying the recording member P; performing movable-body moving; performing image recording; performing temperature detection; performing driving-waveform determination; performing drive-timing determination; and performing drive control. The movable-body moving includes moving the carriage 6 that includes thereon the recording heads 20Y to 20K that eject ink droplets (liquid droplets) onto the recording member P and is supported to be movable in the main-scanning direction perpendicular to the conveying direction of the recording member P in the main-scanning direction. The image recording includes recording an image by feeding driving signals each having a specified driving waveform to the recording heads 20Y to 20K, thereby causing ink droplets to be ejected toward the recording member P, while concurrently moving the carriage 6 in the main-scanning direction by performing the movable-body moving. The temperature detection includes detecting the temperature of the recording heads 20Y to 20K. The driving-waveform determination includes determining the driving waveform of the driving signal based on the temperature of the recording heads 20Y to 20K detected at the temperature detection. The drive-timing determination includes determining drive timing of when to feed the driving signal to the recording head 20Y to 20K based on the temperature of the recording heads 20Y to 20K detected at the temperature detection. The drive control includes applying the driving waveform determined at the driving-waveform determination and the drive timing determined at the drive-timing determination to the image recording to drive the recording head 20Y to 20K in accordance with the driving waveform and the drive timing at the image recording.

Accordingly, the ejection velocity and the ejection timing can be adjusted while holding the volume of the ink droplet ejected from the recording head 20Y to 20K constant regardless of the temperature of the recording heads 20Y, 20M, 20C, and 20K. As a result, it becomes possible to form a high-quality image by reducing distortion of ink-droplet ejection resulting from a decrease in ink viscosity particularly in a high-temperature condition.

According to an aspect of the first embodiment, the image forming apparatus 1 includes a non-transitory computer readable medium having instructions that, when executed by the CPU 111 or the like, which is the control processor, causes the control processor to perform operations including: conveying the recording member P; performing movable-body moving; performing image recording; performing temperature detection; performing driving-waveform determination; performing drive-timing determination; and performing drive control. The movable-body moving includes moving the carriage 6 that includes thereon the recording heads 20Y to 20K that eject ink droplets (liquid droplets) onto the recording member P and is supported to be movable in the main-scanning direction perpendicular to the conveying direction of the recording member P in the main-scanning direction. The image recording includes recording an image by feeding driving signals each having a specified driving waveform to the recording heads 20Y to 20K, thereby causing ink droplets to be ejected toward the recording member P, while concurrently moving the carriage 6 in the main-scanning direction by performing the movable-body moving. The temperature detection includes detecting the temperature of the recording heads 20Y to 20K. The driving-waveform determination includes determining the driving waveform of the driving signal based on the temperature of the recording heads 20Y to 20K detected at the temperature detection. The drive-timing determination includes determining drive timing of when to feed the driving signal to the recording head 20Y to 20K based on the temperature of the recording heads 20Y to 20K detected at the temperature detection. The drive control includes applying the driving waveform determined at the driving-waveform determination and the drive timing determined at the drive-timing determination to the image recording to drive the recording head 20Y to 20K in accordance with the driving waveform and the drive timing at the image recording.

Accordingly, the ejection velocity and the ejection timing can be adjusted while holding the volume of the ink droplet ejected from the recording head 20Y to 20K constant regardless of the temperature of the recording heads 20Y, 20M, 20C, and 20K. As a result, it becomes possible to form a high-quality image by reducing distortion of ink-droplet ejection resulting from a decrease in ink viscosity particularly in a high-temperature condition.

According to an aspect of the first embodiment, the image forming apparatus 1 includes: the ROM (driving-waveform storage unit) 112 that stores therein a driving waveform table containing the driving waveform associated with the temperature of the recording heads 20Y to 20K; and the ROM (drive-timing storage unit) 112 that stores therein a drive timing table containing the drive timing of the recording heads 20Y to 20K associated with the temperature of the recording head. The main control unit 101 serving as the driving-waveform determining unit determines the driving waveform by referring to the driving waveform table based on the temperature of the recording heads 20Y to 20K detected by the temperature sensor 23. The main control unit 101 serving as the drive-timing determining unit determines the drive timing by referring to the drive timing table based on the temperature of the recording heads 20Y to 20K detected by the temperature sensor 23.

Accordingly, the driving waveform and the drive timing, in accordance with which the recording head 20Y, 20M, 20C, or 20K is to be driven, can be determined quickly and easily. The ejection velocity and the ejection timing can be adjusted quickly and accurately regardless of the temperature of the recording heads 20Y, 20M, 20C, and 20K while holding the volume of the ink droplet ejected from the recording head 20Y to 20K constant. As a result, it becomes possible to form a high-quality image by reducing distortion of ink-droplet ejection resulting from a decrease in ink viscosity particularly in a high-temperature condition.

According to an aspect of the first embodiment, the image forming apparatus 1 includes: the ROM (driving-waveform storage unit) 112 that stores therein a driving waveform table containing the driving waveform associated with the temperature of the recording heads 20Y, 20M, 20C, and 20K; and the ROM (drive-timing-correction-value storage unit) 112 that stores therein a drive-timing-correction-value table containing a correction value for predetermined drive timing associated with the temperature of the recording heads 20Y to 20K. The main control unit 101 serving as the driving-waveform determining unit determines the driving waveform by referring to the driving waveform table based on the temperature of the recording heads 20Y to 20K detected by the temperature sensor 23. The main control unit 101 serving as the drive-timing determining unit determines the correction value by referring to the drive-timing-correction-value table based on the temperature of the recording heads 20Y to 20K detected by the temperature sensor 23. The main control unit 101 serving as the image recording unit applies the determined driving waveform and the determined correction value for the drive timing to the head-driving controller 103. The head-driving controller 103 drives the recording head 20Y to 20K in accordance with the driving waveform and corrected drive timing obtained by correcting the predetermined drive timing with the correction value.

Accordingly, the driving waveform and the drive timing, in accordance with which the recording head 20Y, 20M, 20C, and 20K is to be driven, can be determined quickly and further easily. The ejection velocity and the ejection timing can be adjusted quickly and accurately regardless of the temperature of the recording heads 20Y, 20M, 20C, and 20K while holding the volume of the ink droplet ejected from the recording head 20Y to 20K constant. As a result, it becomes possible to form a high-quality image by reducing distortion of ink-droplet ejection resulting from a decrease in ink viscosity particularly in a high-temperature condition.

In the image forming apparatus 1 according to an aspect of the first embodiment, the main control unit 101 serving as the driving-waveform determining unit determines the driving waveform that slows the ejection velocity as the temperature of the recording heads 20Y to 20K detected by the temperature sensor 23 increases while holding an amount of liquid of the ink droplet ejected from the recording head 20Y to 20K. The main control unit 101 serving as the drive-timing determining unit determines the drive timing that accelerates ejection timing of when the recording head 20Y to 20K is to eject the ink droplet as the temperature of the recording heads 20Y to 20K detected by the temperature sensor 23 increases.

Accordingly, it becomes possible to slow the ink ejection velocity and concurrently accelerate the ejection timing according to a change in the amplitude of ink meniscus due to a decrease in the ink viscosity resulting from a rise in the temperature of the recording heads 20Y to 20K. As a result, it becomes possible to form a high-quality image by reducing distortion of liquid ejection that can occur due to a decrease in ink viscosity in a high-temperature condition.

Second Embodiment

Figure 12:
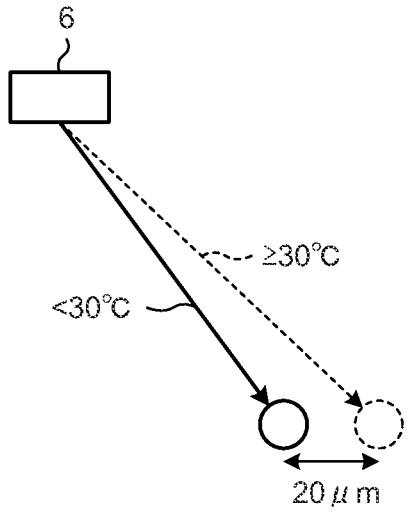
FIG. 12 illustrates relations between temperature of the recording heads and carriage velocity and how an ink droplet flies.
Figure 12:
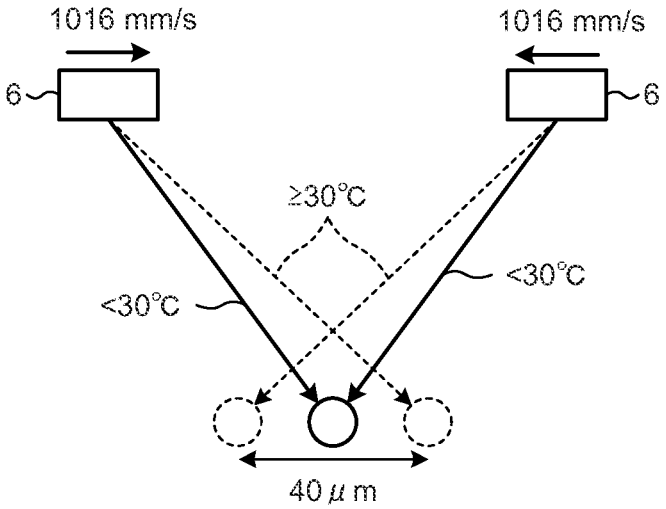
Figure 13:
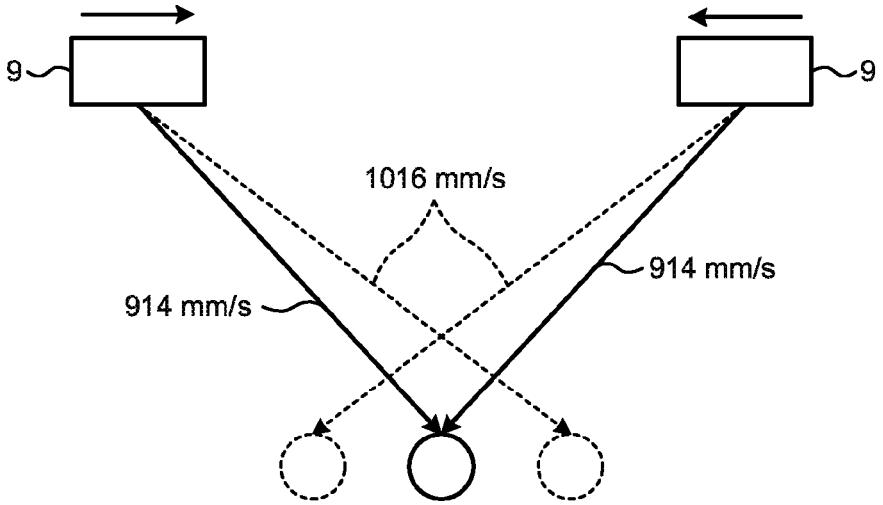
FIG. 13 is an explanatory diagram of how an ink droplet flies at different carriage velocities.

FIGS. 11 to 13 are diagrams illustrating an image forming apparatus, an image forming method, and a computer program product for image forming according to a second embodiment of the present invention.

The second embodiment is applied to an image forming apparatus similar to the image forming apparatus 1 of the first embodiment. The second embodiment is described below using the same reference numerals and symbols as those used in the first embodiment.

The image forming apparatus 1 according to the second embodiment not only holds the volume of ejected ink constant but also controls the driving waveform and a moving velocity of the carriage 6 to adjust the impacting position of ink to a target position regardless of the temperature of the recording heads 20Y, 20M, 20C, and 20K.

As for the driving waveform, the main control unit 101 of the image forming apparatus 1 according to the second embodiment performs control as in the first embodiment. More specifically, the main control unit 101 adjusts the driving waveform of the driving signal to be fed to the recording head 20Y to 20K by referring to the driving waveform table stored in the ROM 112 and illustrated in FIG. 5 based on the temperature of the recording heads 20Y to 20K.

In the image forming apparatus 1 according to the second embodiment, such a carriage velocity table as that illustrated in FIG. 11 is stored in the ROM 112 so that the moving velocity of the carriage 6 can be calculated quickly based on the temperature of the recording heads 20Y to 20K. In the second embodiment, the carriage 6 functions as a recording-head carrier that includes thereon, across an entire image recording width of the recording member P in the main-scanning direction, the recording heads 20Y to 20K that eject ink droplets onto the recording member P, which is a recording medium, and moves relative to the recording member P.

The carriage velocity table (moving velocity table) contains carriage velocities (mm/s) and temperatures of the recording heads 20Y to 20K in 1° C. steps. The carriage velocity is the relative velocity between the recording member P and the carriage 6, which is the recording-head carrier. Contained in the table illustrated in FIG. 11 are the carriage velocities (mm/s) in temperature ranges from a temperature range where the temperature is lower than 1° C. to a temperature range where the temperature is equal to or higher than 44° C. in 1° C. steps.

Upon receiving the detected temperature of the recording heads 20Y to 20K from the temperature sensor 23, the main control unit 101 refers to the carriage velocity table in the ROM 112 to determine a carriage velocity based on the detected temperature. The main control unit 101 determines the carriage velocity associated with the detected temperature and applies the carriage velocity to the main-scanning driver 104. The main-scanning driver 104 drives the carriage 6 at the applied carriage velocity. In the image forming apparatus 1 according to the second embodiment, the main-scanning driver 104, the main-scanning motor 10, the sub-scanning driver 105, the sub-scanning motor 202, the conveying roller (not shown), and the like collectively function as a relative moving unit that moves the carriage 6 and the recording member P in relation to each other. The main control unit 101 also functions as a moving-velocity determining unit that determines the relative moving velocity (which is the moving velocity of the carriage 6 in the main-scanning direction in the second embodiment) between the carriage 6 and the recording member P to be moved by the relative moving unit based on the temperature of the recording heads 20Y to 20K detected by the temperature sensor 23.

Operations of the second embodiment are described below. The image forming apparatus 1 according to the second embodiment forms a high-quality image by reducing distortion of liquid ejection in a high-temperature condition by controlling the driving waveforms to be fed to the recording heads 20Y to 20K and the moving velocity of the carriage 6.

As in the first embodiment, the image forming apparatus 1 according to the second embodiment forms an image on the recording member P by causing the recording heads 20Y to 20K mounted on the carriage 6 moving in the main-scanning direction to eject ink toward the recording member P that is at rest.

In this image forming, the viscosity of the ink changes with temperature as described above. For this reason, in the first embodiment, the driving waveform to be fed to the recording head 20Y to 20K, the ink ejection velocity, and the ink ejection timing are controlled according to the temperature of the recording heads 20Y to 20K.

By contrast, the image forming apparatus 1 according to the second embodiment increases image quality by controlling the driving waveform to be fed to the recording head 20Y to 20K, the ink ejection velocity, and the moving velocity of the carriage 6 including thereon the recording heads 20Y to 20K.

When the image forming apparatus 1 performs image forming, the main control unit 101 receives a detected temperature of the recording heads 20Y to 20K from the temperature sensor 23.

As in the first embodiment, the main control unit 101 applies a driving waveform associated with the detected temperature to the head-driving controller 103 by referring to the driving waveform table in the ROM 112 based on the received detected temperature.

Subsequently, the main control unit 101 acquires a carriage velocity associated with the detected temperature received from the temperature sensor 23 by referring to the carriage velocity table in the ROM 112 based on the detected temperature, and applies the carriage velocity to the main-scanning driver 104.

When the driving waveform has been applied to the head-driving controller 103, the head-driving controller 103 feeds a driving signal having the applied driving waveform to the recording head 20Y to 20K. When the carriage velocity has been applied to the main-scanning driver 104, the main-scanning driver 104 causes the main-scanning motor 10 to rotate at a speed corresponding to the carriage velocity.

More specifically, if the driving waveform is changed to hold the volume of ejected ink constant regardless of the temperature as described above, the ink ejection velocity decreases. The decrease in the ink ejection velocity produces a side effect that the flying period Tj (μs), over which an ink droplet ejected from the recording head 20Y to 20K flies until impacting on the recording member P, becomes long.

If, in this state, the carriage 6 is moved at the same carriage velocity as that in a condition where the temperature of the recording heads 20Y to 20K is lower than 30° C., an impacting position where the ink droplet impacts on the recording member P deviates forward in the moving direction of the carriage 6 from an intended impacting position. The longer the flying period Tj, the farther the impacting position deviates.

Illustrated in (a) of FIG. 12 is how an ink droplet flies in a condition (solid line) where the temperature of the recording heads 20Y to 20K is lower than 30° C. and in a condition (dashed line) where the temperature is equal to or higher than 30° C. FIG. 12 illustrates ink droplets in a situation where: the distance (head-platen distance) between the recording heads 20Y to 20K and the platen 14 is 1.4 mm; the carriage velocity is 1,016 mm/s; the ink-droplet ejection velocity in the condition where the temperature is lower than 30° C. is 7,000 mm/s; and the ink-droplet ejection velocity in the condition where the temperature is equal to or higher than 30° C. is 6,300 mm/s. In FIG. 12, the solid lines indicate the ink droplets flying in the condition where the temperature is lower than 30° C., and the dashed lines indicate the ink droplets flying in the condition where the temperature is equal to or higher than 30° C.

Accordingly, with the carriage velocity being equal, the impacting position of the ink droplet differs by 20 μm between the condition where the temperature is lower than 30° C. and the condition where the temperature is equal to or higher than 30° C.

Illustrated in (b) of FIG. 12 is how an ink droplet flies in what is referred to as bi-directional printing, in which an image is formed during both of forward traveling and backward traveling of the carriage 6 in the main-scanning direction. With printing condition being equal to that of (a) of FIG. 12, in bi-directional printing, ink droplets impact at the same impacting position indicated by the solid line in the condition where the temperature is lower than 30° C.; however, the impacting positions indicated by the dashed lines deviate from each other by 40 μm in the condition where the temperature is equal to or higher than 30° C.

Under the circumstance, the main control unit 101 according to the second embodiment acquires carriage velocity "914 mm/s" from the carriage velocity table in the ROM 112 in the condition where, for instance, the detected temperature is equal to or higher than 30° C. and lower than 31° C., and applies this carriage velocity to the main-scanning driver 104. In short, the main control unit 101 changes setting from "1,016 mm/s", which is previous setting for the condition where the temperature of lower than 30° C., to "914 mm/s".

When the carriage velocity for the condition where the detected temperature is equal to or higher than 30° C. and lower than 31° C. is changed from "1,016 mm/s" to "914 mm/s", a horizontal velocity component of the ink droplet decreases. As a result, as illustrated in FIG. 13, the ink-droplet impacting position changes from the position indicated by the dashed lines of the carriage velocity of "1,016 mm/s" to the position indicated by the solid line, which is 20 μm behind in each of the forward and backward traveling. Thus, it becomes possible to cause the impacting position in forward traveling to coincide with the impacting position in backward traveling.

In the second embodiment, the main control unit 101 changes the carriage velocity based on the temperature detected by the temperature sensor 23. Alternatively, adjustment may be performed by combination of the ink-droplet ejection velocity described in the first embodiment and the carriage velocity.

As described above, according to an aspect of the second embodiment, the image forming apparatus 1 includes: the carriage (recording-head carrier) 6; the relative moving unit; the head-driving controller (image recording unit) 103; the temperature sensor (temperature detecting unit) 23; the main control unit (driving-waveform determining unit) 101; the main control unit (moving-velocity determining unit) 101; and the main control unit (drive control unit) 101. The carriage 6 includes thereon the recording heads 20Y to 20K that eject ink droplets (liquid droplets) onto the recording member P, which is a recording medium, and moves relative to the recording member P. The relative moving unit includes the main-scanning driver 104 that relatively moves the carriage 6 and the recording member P, the main-scanning motor 10, the sub-scanning driver 105, the sub-scanning motor 202, and the conveying roller (not shown). The head-driving controller 103 records an image by feeding driving signals each having a specified driving waveform to the recording heads 20Y to 20K, thereby causing ink droplets to be ejected toward the recording member P, while concurrently causing the relative moving unit to relatively move the carriage 6 and the recording member P. The temperature sensor 23 detects the temperature of the recording heads 20Y to 20K. The main control unit 101 serving as the driving-waveform determining unit determines the driving waveform of the driving signal based on the temperature of the recording heads 20Y to 20K detected by the temperature sensor 23. The main control unit 101 serving as the moving-velocity determining unit determines a relative moving velocity between the carriage 6 and the recording member P to be moved by the relative moving unit based on the temperature of the recording heads 20Y to 20K detected by the temperature sensor 23. The main control unit 101 applies the driving waveform determined by the main control unit 101 serving as the driving-waveform determining unit to the head-driving controller 103 to drive the recording head 20Y to 20K in accordance with the driving waveform, and applies the relative moving velocity determined by the main control unit 101 serving as the moving-velocity determining unit to the relative moving unit to relatively move the carriage 6 and the recording member P at the relative moving velocity.

Accordingly, it becomes possible to adjust the ejection velocity and the conveying velocity of the recording member P, which is the relative velocity between the recording member P and the recording heads 20Y to 20K, while holding the volume of the ink droplet ejected from the recording head 20Y to 20K constant regardless of the temperature of the recording heads 20Y, 20M, 20C, and 20K. As a result, it becomes possible to form a high-quality image by lessening an effect of distortion of ink-droplet ejection resulting from a decrease in ink viscosity particularly in a high-temperature condition.

According to an aspect of the second embodiment, the image forming apparatus 1 performs an image forming method including: performing relative moving; performing image recording; performing temperature detection; performing driving-waveform determination; performing moving-velocity determination; and performing drive control. The relative moving includes moving the carriage 6 including thereon the recording heads 20Y to 20K that eject ink droplets onto the recording member P relative to the recording member P. The image recording includes recording an image by feeding driving signals each having a specified driving waveform to the recording heads 20Y to 20K, thereby causing ink droplets to be ejected toward the recording member P, while concurrently relatively moving the carriage 6 and the recording member P by performing the relative moving. The temperature detection includes detecting the temperature of the recording heads 20Y to 20K. The driving-waveform determination includes determining the driving waveform of the driving signal based on the temperature of the recording heads 20Y to 20K detected at the temperature detection. The moving-velocity determination includes determining the relative moving velocity between the carriage 6 and the recording member P to be moved at the relative moving based on the temperature of the recording heads 20Y to 20K detected at the temperature detection.

The drive control includes applying the driving waveform determined at the driving-waveform determination to the image recording to drive the recording head 20Y to 20K in accordance with the driving waveform, and applying the relative moving velocity determined at the moving-velocity determination to the relative moving to relatively move the carriage 6 and the recording member P at the relative moving velocity.

Accordingly, it becomes possible to adjust the ejection velocity and the conveying velocity of the recording member P, which is the relative velocity between the recording member P and the recording heads 20Y to 20K, while holding the volume of the ink droplet ejected from the recording head 20Y to 20K constant regardless of the temperature of the recording heads 20Y, 20M, 20C, and 20K. As a result, it becomes possible to form a high-quality image by lessening an effect of distortion of ink-droplet ejection resulting from a decrease in ink viscosity particularly in a high-temperature condition.

According to an aspect of the second embodiment, the image forming apparatus 1 includes a non-transitory computer readable medium having instructions that, when executed by the CPU 111 or the like, which is the control processor, cause the control processor to perform operations including: performing relative moving; performing image recording; performing temperature detection; performing driving-waveform determination; performing moving-velocity determination; and performing drive control. The relative moving includes moving the carriage 6 including thereon the recording heads 20Y to 20K that eject ink droplets onto the recording member P relative to the recording member P. The image recording includes recording an image by feeding driving signals each having a specified driving waveform to the recording heads 20Y to 20K, thereby causing ink droplets to be ejected toward the recording member P, while concurrently relatively moving the carriage 6 and the recording member P by performing the relative moving. The temperature detection includes detecting the temperature of the recording heads 20Y to 20K. The driving-waveform determination includes determining the driving waveform of the driving signal based on the temperature of the recording heads 20Y to 20K detected at the temperature detection. The moving-velocity determination includes determining the relative moving velocity between the carriage 6 and the recording member P to be moved at the relative moving based on the temperature of the recording heads 20Y to 20K detected at the temperature detection. The drive control includes applying the driving waveform determined at the driving-waveform determination to the image recording to drive the recording head 20Y to 20K in accordance with the driving waveform, and applying the relative moving velocity determined at the moving-velocity determination to the relative moving to relatively move the carriage 6 and the recording member P at the relative moving velocity.

Accordingly, it becomes possible to adjust the ejection velocity and the conveying velocity of the recording member P, which is the relative velocity between the recording member P and the recording heads 20Y to 20K, while holding the volume of the ink droplet ejected from the recording head 20Y to 20K constant regardless of the temperature of the recording heads 20Y, 20M, 20C, and 20K. As a result, it becomes possible to form a high-quality image by lessening an effect of distortion of ink-droplet ejection resulting from a decrease in ink viscosity particularly in a high-temperature condition.

In the image forming apparatus 1 according to an aspect of the second embodiment, the carriage 6, which is the recording-head carrier, is supported to be movable in the main-scanning direction perpendicular to the conveying direction of the recording member P. The relative moving unit conveys the recording member P while the carriage 6 is moved in the main-scanning direction. The main control unit 101, which is the moving-velocity determining unit, determines the moving velocity of the carriage 6 in the main-scanning direction.

Accordingly, it becomes possible to adjust the ejection velocity and the moving velocity of the recording heads 20Y to 20K in the main-scanning direction in relation to the recording member P while holding the volume of the ink droplet ejected from the recording head 20Y to 20K constant regardless of the temperature of the recording heads 20Y, 20M, 20C, and 20K. As a result, it becomes possible to form a high-quality image by lessening an effect of distortion of ink-droplet ejection resulting from a decrease in ink viscosity particularly in a high-temperature condition.

According to an aspect of the second embodiment, the image forming apparatus 1 includes: the ROM (driving-waveform storage unit) 112 that stores therein a driving waveform table containing the driving waveform associated with the temperature of the recording heads 20Y to 20K; and the ROM (moving-velocity storage unit) 112 that stores therein a carriage velocity table (moving velocity table) containing the relative moving velocity associated with the temperature of the recording heads 20Y to 20K. The main control unit 101 serving as the driving-waveform determining unit determines the driving waveform by referring to the driving waveform table based on the temperature of the recording heads 20Y to 20K detected by the temperature sensor 23. The main control unit 101 serving as the moving-velocity determining unit determines the relative moving velocity by referring to the carriage velocity table based on the temperature of the recording heads 20Y to 20K detected by the temperature sensor 23.

Accordingly, the driving waveform, in accordance with which the recording head 20Y, 20M, 20C, and 20K is to be driven, and the moving velocity, at which the carriage 6 is to be moved, can be determined quickly and easily. It becomes possible to adjust the ejection velocity and the relative moving velocity of the recording heads 20Y to 20K in the main-scanning direction in relation to the recording member P while holding the volume of the ink droplet ejected from the recording head 20Y to 20K constant regardless of the temperature of the recording heads 20Y, 20M, 20C, and 20K. As a result, it becomes possible to form a high-quality image by lessening an effect of distortion of ink-droplet ejection resulting from a decrease in ink viscosity particularly in a high-temperature condition.

In the image forming apparatus 1 according to an aspect of the second embodiment, the main control unit 101 serving as the driving-waveform determining unit determines the driving waveform that slows the ejection velocity as the temperature of the recording heads 20Y to 20K detected by the temperature sensor 23 increases while holding an amount of liquid of the ink droplet ejected from the recording head 20Y to 20K constant. The main control unit 101 serving as the drive-timing determining unit determines the relative moving velocity that slows the relative moving velocity as the temperature of the recording heads 20Y to 20K detected by the temperature sensor 23 increases.

Accordingly, it becomes possible to slow the ink ejection velocity and concurrently slow the relative velocity between the recording heads 20Y to 20K and the recording member P according to a change in the amplitude of ink meniscus resulting from a decrease in the viscosity of the ink due to a rise in the temperature of the recording heads 20Y to 20K. As a result, it becomes possible to form a high-quality image by lessening an effect of distortion of ink-droplet ejection that can occur due to a decrease in ink viscosity in a high-temperature condition.

Third Embodiment

Figure 14:
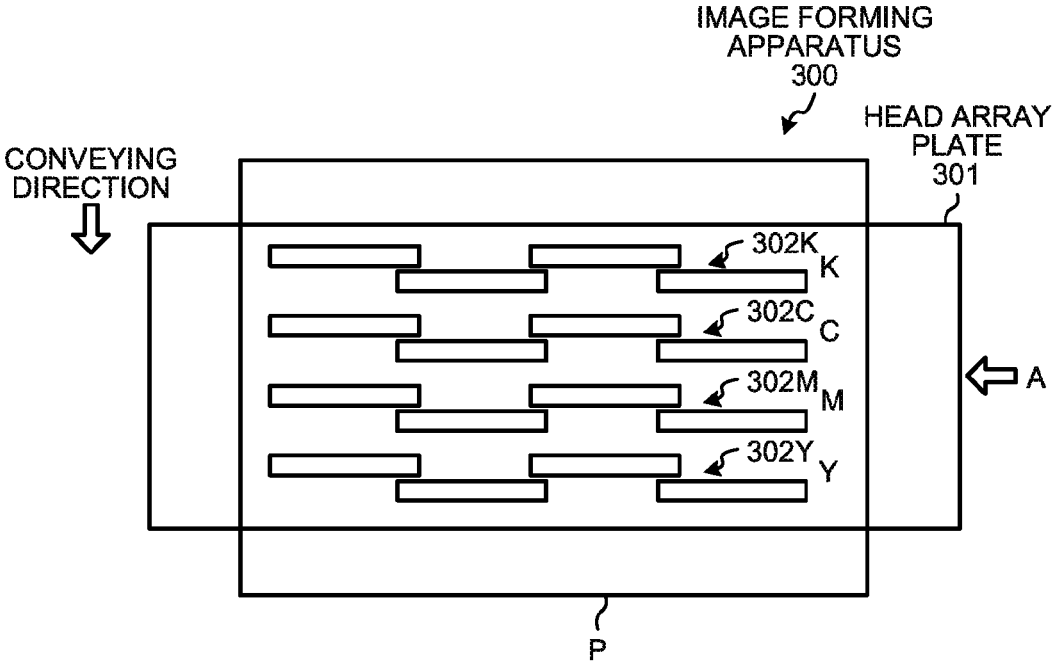
FIG. 14 is a schematic configuration diagram of a head array plate and its relevant portion of an image forming apparatus according to a third embodiment of the present invention.
Figure 15:
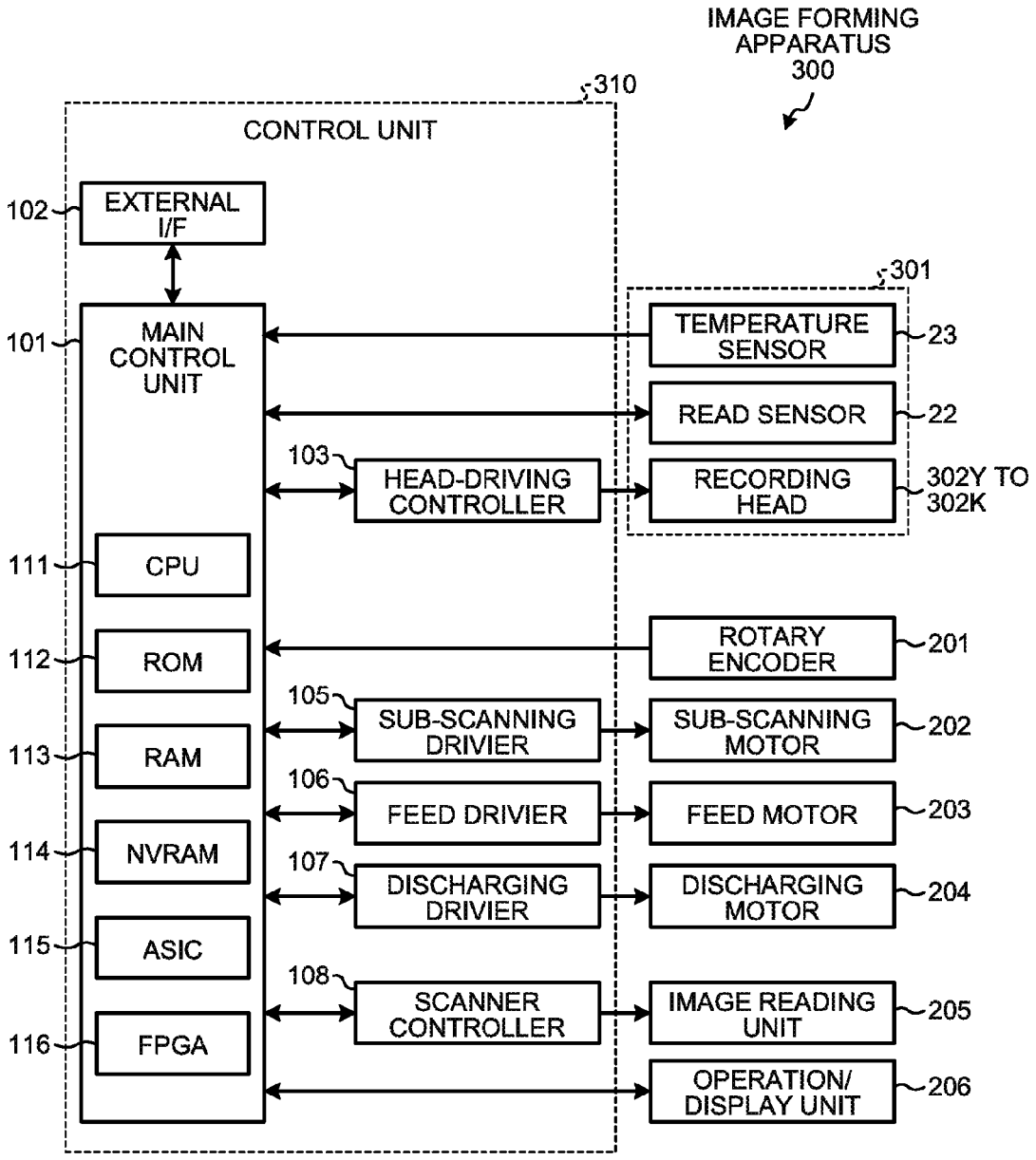
FIG. 15 is a block diagram of a principal portion of the image forming apparatus according to the third embodiment.

FIGS. 14 and 15 are diagrams illustrating an image forming apparatus, an image forming method, and a computer program product for image forming according to a second embodiment of the present invention.

The third embodiment is applied to an image forming apparatus similar to the image forming apparatus 1 of the first embodiment. In description of the third embodiment, like reference numerals are used to denote elements similar to those of the first embodiment, and repeated description is omitted.

The first embodiment and the second embodiment described above are applied to serial liquid-ejecting (inkjet) printing. By contrast, the third embodiment is applied to line liquid-ejecting printing.

FIG. 14 is a schematic configuration diagram of a head array plate 301 and its relevant portion of an image forming apparatus 300 according to the third embodiment.

Referring to FIG. 14, the head array plate (recording-head carrier) 301 is arranged in a manner to face the platen 14 (not shown) at a portion that is longer in the main-scanning direction than an image recording zone (image recording width). The head array plate 301 is supported at its both ends on frames or the like that are on both end portions in the main-scanning direction of the image forming apparatus 300.

Referring to FIG. 14, the head array plate (recording-head carrier) 301 is arranged in a manner to face the platen 14 (not shown) at a portion that is longer in the main-scanning direction than an image recording zone (image recording width). The head array plate 301 is supported at its opposite ends by frames or the like on opposite sides in the main-scanning direction of the image forming apparatus 300.

The head array plate 301 includes recording heads 302Y, 302M, 302C, and 302K for yellow (Y), magenta (M), cyan (C), and black (K), respectively, on the side of the platen 14. The recording heads 302 are formed in a manner to extend across the entire image recording zone in the main-scanning direction.

Each of the recording heads 302Y, 302M, 302C, and 302K has a staggered arrangement in which a plurality of (in the example illustrated in FIG. 14, four) partial recording heads shorter than the entire width of the image recording zone overlap each other by a predetermined length at their lengthwise end portions.

A principal portion of the image forming apparatus 300 of the third embodiment in configured in blocks as illustrated in FIG. 15. Elements similar to those of the first embodiment illustrated in FIG. 1 are denoted by like reference numerals and symbols.

More specifically, the line image forming apparatus 300 of the third embodiment includes the head array plate 301 that includes thereon the recording heads 302Y to 302K extending across the entire zone in the main-scanning direction in place of the carriage 6 that includes thereon the short recording heads 20Y to 20K and moves in the main-scanning direction. The temperature sensor 23 and the read sensor 22 are arranged on the head array plate 301. The read sensor 22 is arranged to be movable relative to the head array plate 301. A control unit 310 may include a sensor-driving control unit that drives and moves the read sensor 22. In the image forming apparatus 300 of the third embodiment, the head array plate 301 is fixedly positioned. Alternatively, the head array plate 301 may be positioned to be movable in the sub-scanning direction.

The control unit 310 of the image forming apparatus 300 of the third embodiment does not need to control moving of the carriage 6. Accordingly, as illustrated in FIG. 15, the image forming apparatus 300 includes neither the main-scanning driver 104 nor the main-scanning motor 10 that are included in the image forming apparatus 1 illustrated in FIG. 1.

The line image forming apparatus 300 conveys the recording member P by causing the sub-scanning driver 105 to control driving of the sub-scanning motor 202 under control of the main control unit 101. The image forming apparatus 300 forms an image by causing the head-driving controller 103 to drive the recording heads 302Y to 302K under control of the main control unit 101 according to image data, thereby causing the recording heads 302Y to 302K to eject ink onto the recording member P. The sub-scanning driver 105, the sub-scanning motor 202, the conveying roller (not shown), and the like collectively function as a relative moving unit that relatively moves the head array plate (recording-head carrier) 301 and the recording member P in the direction perpendicular to the main-scanning direction.

The image forming apparatus 300 may hold a recording-member-conveying-velocity table that contains conveying velocities of the recording member P associated with temperatures of the recording heads 302Y to 302K in 1° C. steps, for example, in the ROM 112. In this case, the main control unit 101 determines a conveying velocity of the recording member P by referring to the recording-member-conveying-velocity table based on temperature of the recording heads 302Y to 302K.

Operations of the third embodiment are described below. The image forming apparatus 300 according to the third embodiment forms a high-quality image by lessening an effect of distortion of liquid ejection in a high-temperature condition by controlling the driving waveforms to be fed to the recording heads 20Y to 20K and the moving velocity of the recording member P.

Figure 16:
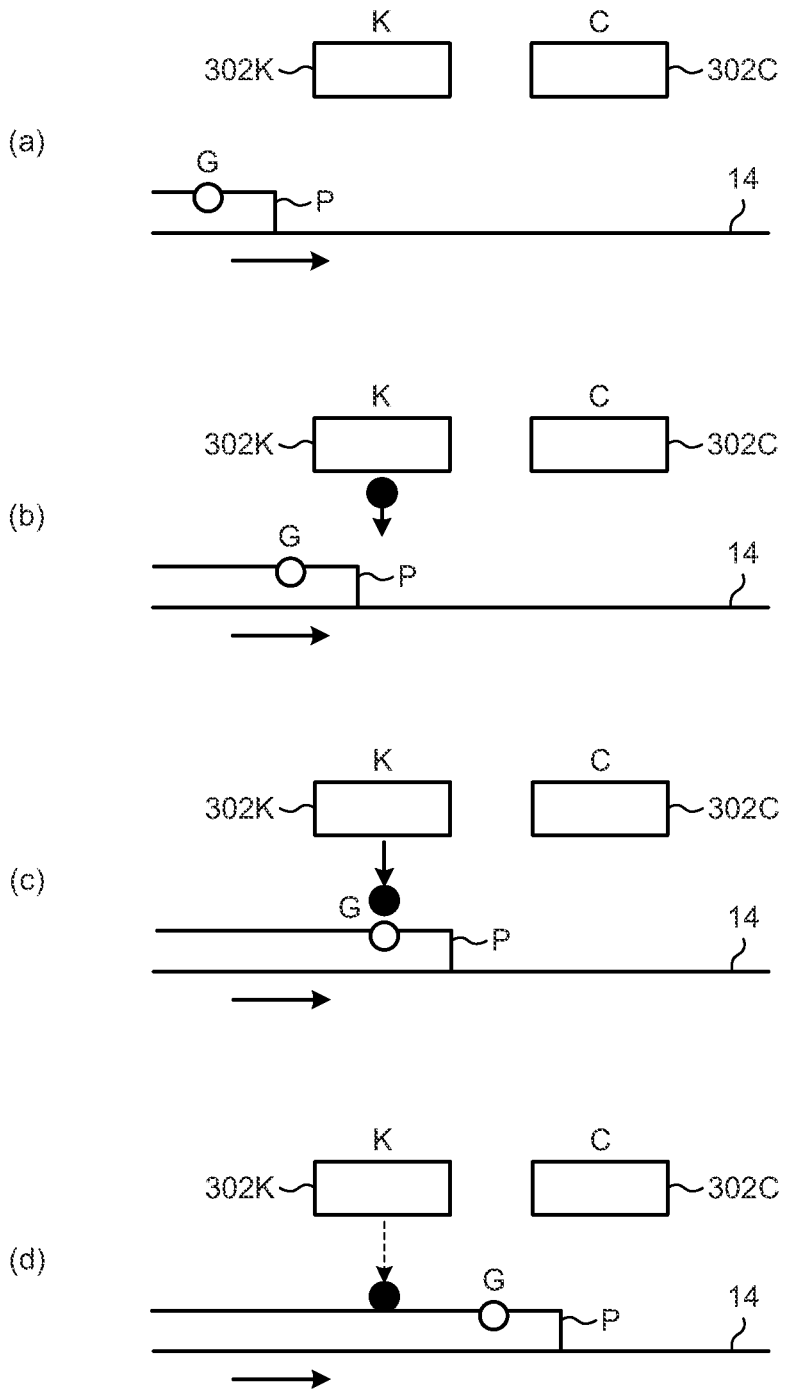
FIG. 16 illustrates relations between temperature of the recording heads and conveying velocity of a recording member and how an ink droplet flies.

The image forming apparatus 300 is a line image forming apparatus. Accordingly, the image forming apparatus 300 conveys the recording member P by causing the sub-scanning driver 105 to control driving of the sub-scanning motor 202 under control of the main control unit 101 so that the recording member P slides over the platen 14 as illustrated in FIG. 16. The image forming apparatus 300 forms an image by causing the head-driving controller 103 to drive the recording heads 302Y to 302K under control of the main control unit 101 according to image data, thereby causing the recording heads 302Y to 302K to eject ink droplets onto the recording member P.

FIG. 16 illustrates diagrams taken along arrow A of FIG. 14. Illustrated in (a) of FIG. 16 is a state in which the recording member P is not conveyed below the recording heads 302Y to 302K yet. At this point in time, in the image forming apparatus 300, the recording member P is not conveyed to the recording heads 302Y to 302K yet and ink droplets are not ejected from the recording heads 302Y to 302K yet. The main control unit 101 acquires image data representing an image to be formed on the recording member P, and determines driving waveforms to be fed to cause the recording heads 302Y to 302K to eject ink according to the image data. As in the first embodiment, the main control unit 101 changes the driving waveforms based on the temperature detected by the temperature sensor 23. The head array plate 301 includes the recording heads 302Y, 302M, 302C, and 302K for Y, M, C, and K colors; however, for the sake of convenience, only the recording heads 302K and 302C are depicted in FIG. 16. Although the recording head 302K is described below, the description holds true for the other recording heads 302Y, 302M, and 302C. In FIG. 16, an intended impacting position on the recording member P of an ink droplet ejected from the recording head 302K is indicated by G.

The main control unit 101 drives the recording head 302K via the head-driving controller 103 at ink-droplet ejection timing calculated from an ink-droplet flying period, which is set in advance for the intended impacting position G on the recording member P, and the conveying velocity of the recording member P.

In a condition where the temperature of the recording heads 302Y to 302K is lower than 30° C., the intended impacting position G of the ink droplet ejected at the ink-droplet ejection timing described above moves toward the recording head 302K as the recording member P is conveyed as illustrated in (b) of FIG. 16.

In the image forming apparatus 300 of the third embodiment, the recording heads 302Y to 302K are fixedly positioned on the head array plate 301. Accordingly, an ink droplet ejected from the recording head 302Y to 302K falls straight down toward the recording member P. As illustrated in (c) of FIG. 16, the ink droplet impacts on the intended impacting position G after a certain period of time.

However, when the image forming apparatus 300 is in a condition where the temperature of the recording heads 302Y to 302K is equal to or higher than 30° C., the ejection velocity of the ink droplet ejected from the recording head 302Y to 302K decreases. As a result, the flying period, over which the ink droplet ejected from the recording head 302Y to 302K flies until impacting on the recording member P, becomes long. Accordingly, as illustrated in (d) of FIG. 16, the ink droplet undesirably impacts on the recording member P at a position behind the intended impacting position G in the conveying direction of the recording member P if the conveying velocity of the recording member P and the ink-droplet ejection timing remain the same. The longer the flying period, the farther the impacting position deviates.

Against the backdrop, the image forming apparatus 300 of the third embodiment includes the temperature sensor 23, which is mounted on the head array plate 301, that detects the temperature of the recording heads 302Y to 302K.

As in the first embodiment, the main control unit 101 changes the ink ejection velocity by controlling the driving waveform to be fed to the recording head 302Y to 302K and performing drive control via the head-driving controller 103 based on the temperature detected by the temperature sensor 23. The main control unit 101 also changes the conveying velocity of the recording member P by controlling driving of the sub-scanning motor 202 via the sub-scanning driver 105 based on the temperature detected by the temperature sensor 23.

Alternatively, the main control unit 101 may perform determination of the conveying velocity of the recording member P based on the temperature of the recording heads 302Y to 302K by acquiring a conveying velocity from the recording-member-conveying-velocity table in the ROM 112 and applying the conveying velocity to the sub-scanning driver 105.

The sub-scanning driver controls driving of the sub-scanning motor 202 based on the applied conveying velocity to convey the recording member P at the applied conveying velocity.

Because the conveying velocity of the recording member P is thus adjusted, the image forming apparatus 300 can cause an ink droplet ejected from the recording head 302Y to 302K to impact at the intended impacting position G on the recording member P.

The main control unit 101 may simultaneously control ink ejection timing by utilizing drive control by the head-driving controller 103 in addition to adjusting the conveying velocity of the recording member P based on the temperature detected by the temperature sensor 23 as described above.

As described above, according to an aspect of the third embodiment, the image forming apparatus 300 includes: the head array plate (recording-head carrier) 301; the relative moving unit; the head-driving controller (image recording unit) 103; the temperature sensor (temperature detecting unit) 23; the main control unit (driving-waveform determining unit) 101; the main control unit (drive-timing determining unit) 101; and the main control unit (drive control unit) 101. The head array plate 301 includes thereon, across the entire image recording width of the recording member P in the main-scanning direction, the recording heads that eject ink droplets (liquid droplets) onto the recording member (recording medium) P and moves relative to the recording member P. The relative moving unit includes the sub-scanning driver 105 that relatively moves the head array plate 301 and the recording member P in the direction perpendicular to the main-scanning direction, the sub-scanning motor 202, and the conveying roller (not shown). The head-driving controller 103 records an image by feeding driving signals each having a specified driving waveform to the recording heads 302Y to 302K, thereby causing ink droplets to be ejected toward the recording member P, while concurrently causing the relative moving unit to relatively move the head array plate 301 and the recording member P. The temperature sensor 23 detects the temperature of the recording heads 302Y to 302K. The main control unit 101 serving as the driving-waveform determining unit determines the driving waveform of the driving signal based on the temperature of the recording heads 302Y to 302K detected by the temperature sensor 23. The main control unit 101 serving as the drive-timing determining unit determines drive timing of when to feed the driving signal to the recording head 302Y to 302K based on the temperature of the recording heads 302Y to 302K detected by the temperature sensor 23. The main control unit 101 serving as the drive control unit applies the driving waveform determined by the main control unit 101 serving as the driving-waveform determining unit and the drive timing determined by the main control unit 101 serving as the drive-timing determining unit to the head-driving controller 103 to cause the head-driving controller 103 to drive the recording head 302Y to 302K in accordance with the driving waveform and the drive timing.

Accordingly, the image forming apparatus 300, which is of a line liquid-ejection head type, can as well adjust the ejection velocity and the ejection timing while holding the volume of the ink droplet ejected from the recording head 302Y to 302K constant regardless of the temperature of the recording heads 302Y to 302K. As a result, it becomes possible to form a high-quality image by reducing distortion of ink-droplet ejection resulting from a decrease in ink viscosity particularly in a high-temperature condition.

According to an aspect of the third embodiment, the image forming apparatus 300 performs an image forming method including: performing relative moving; performing image recording; performing temperature detection; performing driving-waveform determination; performing drive-timing determination; and performing drive control. The relative moving includes moving the head array plate 301 including thereon, at least across the entire image recording width of the recording member P in the main-scanning direction, the recording heads 302Y to 302K that eject ink droplets onto the recording member (recording medium) P relative to the recording member P. The image recording includes recording an image by feeding driving signals each having a specified driving waveform to the recording heads 302Y to 302K, thereby causing ink droplets to be ejected toward the recording member P, while concurrently relatively moving the head array plate 301 and the recording member P by performing the relative moving. The temperature detection includes detecting the temperature of the recording heads 302Y to 302K. The driving-waveform determination includes determining the driving waveform of the driving signal based on the temperature of the recording heads 302Y to 302K detected at the temperature detection. The drive-timing determination includes determining drive timing of when to feed the driving signal to the recording head 302Y to 302K based on the temperature of the recording heads 302Y to 302K detected at the temperature detection. The drive control includes applying the driving waveform determined at the driving-waveform determination and the drive timing determined at the drive-timing determination to the image recording to drive the recording head 302Y to 302K in accordance with the driving waveform and the drive timing at the image recording.

Accordingly, the image forming apparatus 300, which is of a line liquid-ejection head type, can as well adjust the ejection velocity and the ejection timing while holding the volume of the ink droplet ejected from the recording head 302Y to 302K constant regardless of the temperature of the recording heads 302Y to 302K. As a result, it becomes possible to form a high-quality image by reducing distortion of ink-droplet ejection resulting from a decrease in ink viscosity particularly in a high-temperature condition.

According to an aspect of the third embodiment, the image forming apparatus 300 includes a non-transitory computer readable medium having instructions that, when executed by the CPU 111 or the like, which is the control processor, cause the control processor to perform operations including: performing relative moving; performing image recording; performing temperature detection; performing driving-waveform determination; performing drive-timing determination; and performing drive control. The relative moving includes moving the head array plate 301 including thereon, at least across the entire image recording width of the recording member P in the main-scanning direction, the recording heads 302Y to 302K that eject ink droplets onto the recording member (recording medium) P relative to the recording member P. The image recording includes recording an image by feeding driving signals each having a specified driving waveform to the recording heads 302Y to 302K, thereby causing ink droplets to be ejected toward the recording member P, while concurrently relatively moving the head array plate 301 and the recording member P by performing the relative moving. The temperature detection includes detecting the temperature of the recording heads 302Y to 302K. The driving-waveform determination includes determining the driving waveform of the driving signal based on the temperature of the recording heads 302Y to 302K detected at the temperature detection. The drive-timing determination includes determining drive timing of when to feed the driving signal to the recording head 302Y to 302K based on the temperature of the recording heads 302Y to 302K detected at the temperature detection. The drive control includes applying the driving waveform determined at the driving-waveform determination and the drive timing determined at the drive-timing determination to the image recording to drive the recording head 302Y to 302K in accordance with the driving waveform and the drive timing at the image recording.

Accordingly, the image forming apparatus 300, which is of a line liquid-ejection head type, can adjust the ejection velocity and the ejection timing while holding the volume of ink droplet ejected from the recording head 302Y to 302K constant regardless of the temperature of the recording heads 302Y to 302K. As a result, it becomes possible to form a high-quality image by reducing distortion of ink-droplet ejection resulting from a decrease in ink viscosity particularly in a high-temperature condition.

Furthermore, according to an aspect of the third embodiment, the image forming apparatus 300 includes: the ROM (driving-waveform storage unit) 112 that stores therein a driving waveform table containing the driving waveform associated with the temperature of the recording heads 302Y to 302K; and the ROM (drive-timing storage unit) 302 that stores therein a drive timing table containing the drive timing of the recording heads 302Y to 302K associated with the temperature of the recording head. The main control unit 101 serving as the driving-waveform determining unit determines the driving waveform by referring to the driving waveform table based on the temperature of the recording heads 302Y to 302K detected by the temperature sensor 23. The main control unit 101 serving as the drive-timing determining unit determines the drive timing by referring to the drive timing table based on the temperature of the recording heads 302Y to 302K detected by the temperature sensor 23.

Accordingly, the image forming apparatus 300, which is of a line liquid-ejection head type, can determine the driving waveform and the drive timing, in accordance with which the recording head 302Y to 302K is to be driven, quickly and easily. Thus, the image forming apparatus 300 can adjust the ejection velocity and the ejection timing quickly and accurately regardless of the temperature of the recording heads 302Y to 302K while holding the volume of the ink droplet ejected from the recording head 302Y to 302K constant. As a result, it becomes possible to form a high-quality image by reducing distortion of ink-droplet ejection resulting from a decrease in ink viscosity particularly in a high-temperature condition.

According to an aspect of the third embodiment, the image forming apparatus 300 includes: the ROM (driving-waveform storage unit) 112 that stores therein a driving waveform table containing the driving waveform associated with the temperature of the recording heads 302Y to 302K; and the ROM (drive-timing-correction-value storage unit) 112 that stores therein a drive-timing-correction-value table containing a correction value for predetermined drive timing associated with the temperature of the recording heads 302Y to 302K. The main control unit 101 serving as the driving-waveform determining unit determines the driving waveform by referring to the driving waveform table based on the temperature of the recording heads 302Y to 302K detected by the temperature sensor 23. The main control unit 101 serving as the drive-timing determining unit determines the correction value by referring to the drive-timing-correction-value table based on the temperature of the recording heads 302Y to 302K detected by the temperature sensor 23. The main control unit 101 serving as the drive control unit applies the driving waveform determined by the main control unit 101 serving as the driving-waveform determining unit and the correction value for the drive timing determined by the main control unit 101 serving as the drive-timing determining unit to the head-driving controller 103. The head-driving controller 103 drives the recording head 302Y to 302K in accordance with the driving waveform and corrected drive timing obtained by correcting the predetermined drive timing with the correction value.

Accordingly, the image forming apparatus 300, which is of a line liquid-ejection head type, can determine the driving waveform and the drive timing, in accordance with which the recording head 302Y to 302K is to be driven, quickly and further easily. The image forming apparatus 300 can also adjust the ejection velocity and the ejection timing quickly and accurately regardless of the temperature of the recording heads 302Y to 302K while holding the volume of the ink droplet ejected from the recording head 302Y to 302K constant. As a result, it becomes possible to form a high-quality image by reducing distortion of ink-droplet ejection resulting from a decrease in ink viscosity particularly in a high-temperature condition.

According to an aspect of the third embodiment, the image forming apparatus 300 includes: the head array plate (recording-head carrier) 301; the relative moving unit; the head-driving controller (image recording unit) 103; the temperature sensor (temperature detecting unit) 23; the main control unit (driving-waveform determining unit) 101; the main control unit (moving-velocity determining unit) 101; and the main control unit (drive control unit) 101. The head array plate 301 includes thereon the recording heads 302Y to 302K that eject ink droplets onto the recording member P and moves relative to the recording member P. The relative moving unit relatively moves the head array plate 301 and the recording member P. The head-driving controller 103 records an image by feeding driving signals each having a specified driving waveform to the recording heads 302Y to 302K, thereby causing ink droplets to be ejected toward the recording member P, while concurrently causing the relative moving unit to relatively move the head array plate 301 and the recording member P. The temperature sensor 23 detects the temperature of the recording heads 302Y to 302K. The main control unit 101 serving as the driving-waveform determining unit determines the driving waveform of the driving signal based on the temperature of the recording heads 302Y to 302K detected by the temperature sensor 23. The main control unit 101 serving as the moving-velocity determining unit determines the relative moving velocity between the head array plate 301 and the recording member P to be moved by the relative moving unit based on the temperature of the recording heads 302Y to 302K detected by the temperature sensor 23. The main control unit 101 serving as the drive control unit applies the driving waveform determined by the main control unit 101 serving as the driving-waveform determining unit to the head-driving controller 103 to drive the recording head 302Y to 302K in accordance with the driving waveform, and applies the relative moving velocity determined by the main control unit 101 serving as the moving-velocity determining unit to the relative moving unit to relatively move the carriage 6 and the recording member P at the relative moving velocity. In particular, the recording heads 302Y to 302K are mounted on the head array plate 301, which is the recording-head carrier, at least across the entire image recording width of the recording member P in the main-scanning direction. The relative moving unit conveys the recording member P. The main control unit 101 serving as the moving-velocity determining unit determines the conveying velocity of the recording member P as the relative moving velocity.

Accordingly, the image forming apparatus 300, which is of a line liquid-ejection head type, can adjust the ejection velocity and the conveying velocity of the recording member P, which is the relative velocity between the recording member P and the recording heads 302Y to 302K, while holding the volume of the ink droplet ejected from the recording head 302Y to 302K constant regardless of the temperature of the recording heads 302Y to 302K. As a result, it becomes possible to form a high-quality image by lessening an effect of distortion of ink-droplet ejection resulting from a decrease in ink viscosity particularly in a high-temperature condition.

According to an aspect of the third embodiment, the image forming apparatus 300 performs an image forming method including: performing relative moving; performing image recording; performing temperature detection; performing driving-waveform determination; performing moving-velocity determination; and performing drive control. The relative moving includes moving the head array plate 301, on which the recording heads 302Y to 302K that eject ink droplets onto the recording member P are mounted, relative to the recording member P. The image recording includes recording an image by feeding driving signals each having a specified driving waveform to the recording heads 302Y to 302K, thereby causing ink droplets to be ejected toward the recording member P, while concurrently relatively moving the head array plate 301 and the recording member P by performing the relative moving. The temperature detection includes detecting the temperature of the recording heads 302Y to 302K. The driving-waveform determination includes determining the driving waveform of the driving signal based on the temperature of the recording heads 302Y to 302K detected at the temperature detection. The moving-velocity determination includes determining the relative moving velocity between the head array plate 301 and the recording member P to be moved at the relative moving based on the temperature of the recording heads 302Y to 302K detected at the temperature detection. The drive control includes applying the driving waveform determined at the driving-waveform determination to the image recording to drive the recording head 302Y to 302K in accordance with the driving waveform, and applying the relative moving velocity determined at the moving-velocity determination to the relative moving to relatively move the carriage 6 and the recording member P at the relative moving velocity.

Accordingly, the image forming apparatus 300, which is of a line liquid-ejection head type, can adjust the ejection velocity and the conveying velocity of the recording member P, which is the relative velocity between the recording member P and the recording heads 302Y to 302K, while holding the volume of the ink droplet ejected from the recording head 302Y to 302K constant regardless of the temperature of the recording heads 302Y to 302K. As a result, it becomes possible to form a high-quality image by lessening an effect of distortion of ink-droplet ejection resulting from a decrease in ink viscosity particularly in a high-temperature condition.

According to an aspect of the third embodiment, the image forming apparatus 300 includes a non-transitory computer readable medium having instructions that, when executed by the CPU 111 or the like, which is the control processor, cause the control processor to perform operations including: performing relative moving; performing image recording; performing temperature detection; performing driving-waveform determination; performing moving-velocity determination; and performing drive control. The relative moving includes moving the head array plate 301, on which the recording heads 302Y to 302K that eject ink droplets onto the recording member P are mounted, relative to the recording member P. The image recording includes recording an image by feeding driving signals each having a specified driving waveform to the recording heads 302Y to 302K, thereby causing ink droplets to be ejected toward the recording member P, while concurrently relatively moving the head array plate 301 and the recording member P by performing the relative moving. The temperature detection includes detecting the temperature of the recording heads 302Y to 302K. The driving-waveform determination includes determining the driving waveform of the driving signal based on the temperature of the recording heads 302Y to 302K detected at the temperature detection. The moving-velocity determination includes determining the relative moving velocity between the head array plate 301 and the recording member P to be moved at the relative moving based on the temperature of the recording heads 302Y to 302K detected at the temperature detection. The drive control includes applying the driving waveform determined at the driving-waveform determination to the image recording to drive the recording head 302Y to 302K in accordance with the driving waveform, and applying the relative moving velocity determined at the moving-velocity determination to the relative moving to relatively move the carriage 6 and the recording member P at the relative moving velocity.

Accordingly, the image forming apparatus 300, which is of a line liquid-ejection head type, can adjust the ejection velocity and the conveying velocity of the recording member P, which is the relative velocity between the recording member P and the recording heads 302Y to 302K, while holding the volume of the ink droplet ejected from the recording head 302Y to 302K constant regardless of the temperature of the recording heads 302Y to 302K. As a result, it becomes possible to form a high-quality image by lessening an effect of distortion of ink-droplet ejection resulting from a decrease in ink viscosity particularly in a high-temperature condition.

According to an aspect of the third embodiment, the image forming apparatus 300 includes: the ROM (driving-waveform storage unit) 112 that stores therein a driving waveform table containing the driving waveform associated with the temperature of the recording heads 302Y to 302K; and the ROM (moving-velocity storage unit) 112 that stores therein a carriage velocity table (moving velocity table) containing the relative moving velocity associated with the temperature of the recording heads 302Y to 302K. The main control unit 101 serving as the driving-waveform determining unit determines the driving waveform by referring to the driving waveform table based on the temperature of the recording heads 302Y to 302K detected by the temperature sensor 23. The main control unit 101 serving as the moving-velocity determining unit determines the conveying velocity, which is the relative moving velocity, by referring to the conveying velocity table based on the temperature of the recording heads 302Y to 302K detected by the temperature sensor 23.

Accordingly, the image forming apparatus 300, which is of a line liquid-ejection head type, can determine the driving waveform in accordance with which the recording head 302Y to 302K is to be driven and the conveying velocity at which the recording member P is to be conveyed quickly and easily. Thus, the image forming apparatus 300 can adjust the ejection velocity and the conveying velocity of the recording member P regardless of the temperature of the recording heads 302Y to 302K while holding the volume of the ink droplet ejected from the recording head 302Y to 302K constant. As a result, it becomes possible to form a high-quality image by lessening an effect of distortion of ink-droplet ejection resulting from a decrease in ink viscosity particularly in a high-temperature condition.

In the image forming apparatus 1 according to an aspect of the third embodiment, the main control unit 101 serving as the driving-waveform determining unit determines the driving waveform that slows the ejection velocity as the temperature of the recording heads 302Y to 302K detected by the temperature sensor 23 increases, while holding an amount of liquid of the ink droplet ejected from the recording head 302Y to 302K constant. The main control unit 101 serving as the moving-velocity determining unit determines the relative moving velocity that slows the relative moving velocity as the temperature of the recording heads 302Y to 302K detected by the temperature sensor 23 increases.

Accordingly, it becomes possible to slow the ink ejection velocity and to slow the relative velocity between the recording heads 302Y to 302K and the recording member P according to a change in the amplitude of ink meniscus resulting from a decrease in the viscosity of the ink due to a rise in the temperature of the recording heads 302Y to 302K. As a result, it becomes possible to form a high-quality image by lessening an effect of distortion of ink-droplet ejection resulting from a decrease in ink viscosity in a high-temperature condition.

The preferred embodiments of the present invention have been described above; however, the present invention is not restricted to the embodiments described above and, as a matter of course, various modifications can be made without departing from the scope of the present invention.

According to an aspect of the present invention, a high-quality image can be formed by reducing distortion of liquid ejection that can occur in a high-temperature condition.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a recording-head carrier including a recording head for ejecting a liquid droplet onto a recording medium, the recording-head carrier moving relative to the recording medium;

a relative moving unit configured to relatively move the recording-head carrier and the recording medium;

an image recording unit configured to drive the recording head by a driving signal having a specified driving waveform to eject liquid droplets toward the recording medium to thus record an image while causing the relative moving unit to relatively move the recording-head carrier and the recording medium;

a temperature detecting unit configured to detect a temperature near the recording head; and a controller configured to determine whether the detected temperature is lower or higher than a predetermined temperature;

the controller configured to, when the detected temperature is lower than the predetermined temperature, set the driving waveform as a first driving waveform based on the detected temperature referred to for the determining as the drive timing remains unchanged from the predetermined timing; and the controller configured to, when the detected temperature is equal to or higher than the predetermined temperature, set the driving waveform as a second driving waveform different from the first driving waveform based on the detected temperature referred to for the determining, and to set the drive timing as timing with a delay from the predetermined timing, the delay being determined depending on the detected temperature.

2. The image forming apparatus according to claim 1, further comprising:

memory configured to store an assignment of different temperature ranges to different driving waveforms, and an assignment of weighting factors for individual temperatures within each temperature range;

the controller configured to apply the driving waveform to the recording head according to at least the assignment.

3. The image forming apparatus according to claim 1, further comprising:

memory configured to store an assignment of different temperature ranges to different driving waveforms, an assignment of weighting factors for individual temperatures within each temperature range, and an assignment of delay values to the individual temperatures, wherein each temperature within the range is associated with different weighting factors in a memory;

the controller configured to apply the driving waveform to the recording head according to at least the assignment.

4. The image forming apparatus according to claim 1, wherein the controller is configured to maintain a volume amount of ink ejected from the recording head while the driving waveform is applied to the recording head.

5. The image forming apparatus according to claim 1, wherein the second driving waveform to be set when the temperature is higher than the predetermined temperature is different from the first driving waveform in a magnification ratio of a voltage of the driving waveform.

6. An image forming method comprising:

relatively moving a recording-head carrier and a recording medium, the recording-head carrier including a recording head for ejecting a liquid droplet onto the recording medium;

driving the recording head by a driving signal having a specified driving waveform to eject liquid droplets toward the recording medium to thus record an image while relatively moving the recording-head carrier and the recording medium;

detecting a temperature near the recording head;

determining whether the detected temperature is lower or higher than a predetermine temperature;

when the detected temperature is lower than the predetermined temperature, setting the driving waveform as a first driving waveform based on the detected temperature as the drive timing remains unchanged from predetermined timing; and when the detected temperature is equal to or higher than the predetermined temperature, setting the driving waveform as a second driving waveform different than the first driving waveform based on the detected temperature referred to for the determining, and setting the drive timing as timing with a delay from the predetermined timing, the delay being determined depending on the detected temperature.

7. A non-transitory computer-readable storage medium with an executable program stored thereon and executed by a computer, wherein the program instructs the computer to perform:

relatively moving a recording-head carrier and a recording medium, the recording-head carrier including a recording head for ejecting a liquid droplet onto the recording medium;

driving the recording head by a driving signal having a specified driving waveform to eject liquid droplets toward the recording medium to thus record an image while relatively moving the recording-head carrier and the recording medium;

detecting a temperature near the recording head;

determining whether the detected temperature is lower or higher than a predetermine temperature;

when the detected temperature is lower than the predetermined temperature, setting the driving waveform as a first driving waveform based on the detected temperature as the drive timing remains unchanged from predetermined timing; and when the detected temperature is equal to or higher than the predetermined temperature, setting the driving waveform as a second driving waveform different than the first driving waveform based on the detected temperature referred to for the determining, and setting the drive timing as timing with a delay from the predetermined timing, the delay being determined depending on the detected temperature.

* * * * *